US005926518A

United States Patent [19]

Asokawa

[11] Patent Number: 5,926,518

[45] Date of Patent: Jul. 20, 1999

[54] DEVICE FOR MEASURING THE NUMBER OF PASS PERSONS AND A MANAGEMENT SYSTEM EMPLOYING SAME

[75] Inventor: Yoshinobu Asokawa, Kyoto, Japan

[73] Assignee: Omron Corporation, Kyoto, Japan

[21] Appl. No.: 08/871,406

[22] Filed: Jun. 9, 1997

[51] Int. Cl.[6] ..... G06M 7/00

[52] U.S. Cl. ..... 377/6; 377/10

[58] Field of Search ..... 377/6, 10

[56] References Cited

U.S. PATENT DOCUMENTS 4,303,851 12/1981 Mottier ..... 377/6

4,847,485 7/1989 Koelsch ..... 377/6

*Primary Examiner*—Margaret R. Wambach

*Attorney, Agent, or Firm*—Dickstein Shapiro Morin & Oshinsky LLP

[57] ABSTRACT

A device for measuring the number of persons without any affection by overlap of persons in any direction, sunlight variations, shadows, or the like includes a plurality of cameras arranged in parallel with respect to their optical axes for taking an image in a measuring area to measure the number of persons, an extraction unit for extracting a person based on image data taken by said plurality of cameras, a trace unit for tracing the person extracted by the extraction unit, and a decision unit for deciding whether or not a decision line is passed based on the data produced by the trace unit and to increase the number of passing persons when the line is passed. In the extraction unit, the persons overlapping in a depth direction can be precisely separated by employing space coordinate data by correspondence in a plurality of images taken by the plurality of cameras at the same timing. The decision unit decides that one person has passed when initial and end points of a translation locus of the person are respectively positioned on both sides of the decision line set in a gateway.

20 Claims, 36 Drawing Sheets

FIG. 19A

INPUT EXAMPLE OF VARIATION FACTOR DATA

| DATE | TIME | WEATHER | HUMIDITY | SALES PROMOTION | LOCAL INFORMATION |
|---|---|---|---|---|---|
| 3 (FRI) | 9:00 | FINE | 50 | NONE | |
| | 12:00 | FINE | 50 | | |
| | 15:00 | CLOUDY | 60 | | |
| | 18:00 | CLOUDY | 60 | | FIREWORKS DISPLAY |
| 4 (SAT) | 9:00 | CLOUDY | 70 | NEWSPAPER ADS | |
| | 12:00 | DRIZZLE | 80 | | |
| | 15:00 | RAIN | 80 | | CONCERT |
| | 18:00 | RAIN | 80 | | |

FIG. 19B

OUTPUT EXAMPLE OF ANALYTIC RESULT (PAST SIX WEEK AVERAGE: 15% DECREASE IN CASE OF RAIN)

| TIME | WEEKDAY | FRIDAY | SATURDAY | SUNDAY |
|---|---|---|---|---|
| 9: – 12: | 15 | 14 | 18 | 17 |
| 12: – 15: | 32 | 30 | 43 | 44 |
| 15: – 18: | 20 | 23 | 50 | 53 |
| 18: – 21: | 31 | 48 | 63 | 45 |

FIG. 22

FORECAST OF TOMORROW

| | |
|---|---|
| 9:-12: | 30PERSONS |
| 12:-15: | 55PERSONS |
| 15:-18: | 45PERSONS |
| 18:-21: | 75PERSONS |
| TOTAL | 205±15PERSONS |

FORECAST OF NEXT WEEK

| | |
|---|---|
| MON. | 205±15PERSONS |
| TUE. | 220±20PERSONS |
| WED. | 200±15PERSONS |
| THU. | CLOSED |
| FRI. | 300±25PERSONS |
| SAT. | 455±30PERSONS |
| SUN. | 545±40PERSONS |

OUTPUT EXAMPLE:
FORECASTED DATA OF
NUMBER OF PERSONS

FIG. 25

INPUT EXAMPLE OF SALES DATA

| TIME | BOX LUNCH | SANDWICH | BREAD | MILK |
|---|---|---|---|---|
| 9:30 | 2 | 6 | 8 | 7 |
| 10:00 | 0 | 2 | 1 | 4 |
| 10:30 | 0 | 2 | 0 | 2 |
| 11:00 | 1 | 0 | 0 | 0 |
| 11:30 | 2 | 3 | 5 | 0 |
| 12:00 | 6 | 5 | 7 | 5 |
| 12:30 | 15 | 20 | 15 | 7 |
| 13:00 | 7 | 5 | 5 | 3 |

FIG. 28

OUTPUT EXAMPLE OF SALES PORECAST DATA

| TIME | BOX LUNCH | SANDWICH | BREAD | MILK |
|---|---|---|---|---|
| 9:-12: | 15 | 30 | 30 | 30 |
| 12:-15: | 30 | 40 | 20 | 10 |
| 15:-18: | 10 | 10 | 10 | 10 |
| 18:-21: | 20 | 15 | 5 | 5 |
| 21:-24: | 20 | 30 | 5 | 5 |

FIG. 31

INPUT EXAMPLE OF STOCK DATA

| TIME | BOX LUNCH | SANDWICH | BREAD | MILK |
|---|---|---|---|---|
| 9:30 | 4 | 14 | 43 | 29 |
| 10:00 | 4 | 12 | 42 | 25 |
| 10:30 | 4 | 10 | 42 | 23 |
| 11:00 | 3 | 10 | 42 | 23 |
| 11:30 | 31 (30RECEIPT) | 37 (30RECEIPT) | 37 | 23 |
| 12:00 | 25 | 32 | 30 | 18 |
| 12:30 | 10 | 12 | 15 | 11 |
| 13:00 | 3 | 7 | 10 | 8 |

FIG. 32

OUTPUT EXAMPLE OF ORDER DATA

| TIME | BOX LUNCH | SANDWICH | BREAD | MILK |
|---|---|---|---|---|
| 8:00 DELIVERY | 25 | 50 | 50 | 45 |
| 11:00 DELIVERY | 45 | 40 | – | – |
| 16:00 DELIVERY | 35 | 20 | 20 | 20 |

FIG. 34

| INITIAL POINT / END POINT | AREA "A" | AREA "B" | AREA "C" |
|---|---|---|---|
| AREA "A" | PASS WITHIN SHOP | ENTRY FROM AREA "B" | ENTRY FROM AREA "C" |
| AREA "B" | EXIT TO AREA "B" | PASS WITHIN AREA "B" | PASS FROM AREA "C" TO AREA "B" |
| AREA "C" | EXIT TO AREA "C" | PASS FROM AREA "B" TO AREA "C" | PASS WITHIN AREA "C" |

DEVICE FOR MEASURING THE NUMBER OF PASS PERSONS AND A MANAGEMENT SYSTEM EMPLOYING SAME

BACKGROUND OF THE INVENTION

1. Field of the Invention

This invention relates to a device for measuring the number of pass persons who pass an area, and more particularly, an improved system employing the device for managing the number of entry persons who enter the area and exit persons who leave the area.

2. Discussion of the Related Art

There has been heretofore proposed a device for automatically measuring the number of persons who pass a gateway or passage without employing any ID cards, pass gates or the like, in which the passage (pass gate) is designed as a measuring area to allow the pass by persons one by one and a pair of or a plurality pairs of through-beam type sensors are arranged on both sides of the passage to detect in response to the interruption of the light beam whether or not a person has passed the passage. The number of the persons who passed the passage is measured by counting the number of the interruptions (pulses).

There also has been proposed a device, in which a sensor measuring distances is installed above an entrance to detect changes of the height of persons passing the entrance for counting the number of the persons.

In another conventional device, an image in a measuring area taken by a television camera is compared with the image on its former frame and a background to extract a moving object based on differences by such comparison. The device decides whether or not the extracted moving object has passed an entrance to measure the number of persons.

The foregoing conventional devices, however, have the disadvantages described hereinafter.

In the device employing the through-beam sensors, the separation when persons have entered abreast is not satisfactory. The device functions well only when there are a very small number of persons passing the passage, or may be applied to so designed pass gate where passengers are allowed to pass one by one, but it is not suitable for versatile use.

The conventional device employing the sensor measuring distances has the disadvantages that the sensor cannot be installed into the high ceiling and the measurable area is narrow because other area than a portion just below the sensor cannot be measured.

The conventional device employing the television camera to use differences between the image in the camera and the background/frame has the problems of a lowering of separation by a shadow and a lowering of separation by omission of a difference in the result. In the area other than the portion just under the camera, the accuracy of the separation is much lowered because of an overlap by the persons.

Thus, any conventional devices have the problem that they cannot accurately measure the number of persons with versatility.

SUMMARY OF THE INVENTION

It is, therefore, a primary object of this invention to provide an improved device which may resolve the above-mentioned problems, precisely measure the number of passing persons without any affection by person's overlap in any direction and sunlight changes or shadows and even when a large number of persons pass a measuring area, such as an entrance, at a time, and have little restriction about its installation, and to further provide an entry-and-exit person management system employing the pass person measuring device to manage the number of entry and exit persons.

It is a further object of this invention to provide a device which finds a movement flow of a person and the number of entering, staying and leaving persons, and provides information suitable to sales management.

It is a still further object of this invention to provide a system which is applicable to an improved entry-and-exit person management system which is useful for business management.

In accordance with a first aspect of this invention, there is provides a pass person measuring device for measuring the number of passing persons, which includes a plurality of camera means arranged in parallel (this invention is not limited to "strict parallel", but includes "near parallel") with respect to their optical axes for taking an image in a measuring area to measure the number of persons, an extracting means for extracting a person based on image data taken by the plurality of camera means, a tracing means for tracing the person extracted by the extracting means, and a decision means for counting the number of persons passing a predetermined measuring position (a decision line) based on the data provided by the tracing means, wherein the extraction of the passing person employs space coordinate data by correspondence between a plurality of images provided at the same timing by the plurality of camera means.

The coordinates of each image of the same object (person) to be measured which is taken at the same timing by the plurality of camera means having near parallel optical axes are different, in which the camera means may be arranged vertically or aslant provided that the optical axes are nearly parallel though they may be exemplarily arranged horizontally. The shorter the distance from an image taking plane to an object to be taken (a measured object taken by the camera means) is, the larger the parallax by such difference is. The distance to the measured object may be calculated by the parallax and the focal length of a lens; the size of an image element; an interval of the measured object, and moreover the space coordinate values (space coordinate data) of the measured object may be calculated by the set positions and set angles of the camera means. It may be easily discriminated by finding space coordinate values whether the same person exists or another person exists apart from one person in a depth direction though they just happen to look overlapped each other, when an overlap exists in an image on a single frame.

The employment of space coordinate data produced by correspondence in a plurality of images taken by the plurality of camera means to measure the number of passing persons provides the following advantages:

1. The measuring accuracy is not deteriorated by the changes of lighting or sunlight.

2. The measuring accuracy is not deteriorated by shadow because the height is found.

3. Even if persons overlap in any direction in case that the measuring area is set outside the position just under the setting position of the camera means (having a predetermined angle of depression), each person may be precisely separated. Thus, the number of passing persons may be precisely counted without deterioration about its measuring accuracy.

Preferably the counting means for counting the number of persons passing the predetermined measuring position is further provided with a function for discriminating a movement direction of a person passing the measuring position. Moreover, the measuring area may be a gateway (a gateway of a whole store or each tenant shop or room in a store), and the counting means for counting the number of persons passing the predetermined measuring position may discriminate between an entry person and an exit or leave person based on a movement direction of the person which is provided by the tracing means.

If a movement direction of a person is considered when the number of moving objects (persons) passing a measuring position is measured, the passing direction at the measuring position can be found. Assuming that the measuring position is set across a passage, it can be known in addition to a volume of the whole pass in the passage which direction in the passage, upward or downward, is walked by a larger number of persons. When the measuring position is a gateway of a store, the number of entry persons who enter the gateway and exit persons who leave the gateway can be known. Thus, it can be known how many persons stay within the store in a time zone [(the number of stay persons)=(the number of entry persons)−(the number of exit persons)].

Preferably, the extracting means may obtain space coordinate data of the respective characteristic points constituting a person, and extract the respective persons by recognizing that the obtained characteristic points having near distances are based on the same person by integrating the same and the points having far distances are based on a different person.

In case that the moving object is a person, the highest portion corresponds to a head of the person and is located in its center. A lower portion representing shoulders exists around the head. In a ground plane projected from the upward, the characteristic points constituting one person gather around the characteristic point corresponding to the head (a portion having the highest coordinate values in space coordinates), and are located within a predetermined radius therefrom. Since data available in a height direction can be obtained by extracting a person with space coordinate data in this invention, a clustering operation is executed to gather the characteristic points having near distances into one cluster for separating each person.

In accordance with a second aspect of this invention, the pass person measuring device is further provided an excluding means for excluding a particular person from the extracted and traced persons, whereby particular persons such as clerks, sweeper janitors or the like may be excluded from the number of enter and exit persons and a substantial number of enter and exit persons may be precisely measured.

If desired, a different measuring position may be provided on the outside of the gateway so that a person walking on the outside can be counted, whereby the number of persons passing in front of an institution such as a store and the number of persons entering and leaving the institution are simultaneously measured. Accordingly, comparison of appeals about institutions and conditions of location for a chain store development may be quantitatively analyzed relating to the increase and decrease of the number of passing persons and the number of entering persons.

Keith The device may be designed to count the number of persons passing a gateway by setting the measuring position for finding a passage in the image at a predetermined distance from the position corresponding to the gateway in the image to count the number of persons passing the gateway based on the set temporal measuring position. The number of persons entering and leaving the gateway in an overlapping relationship may be precisely measured without enlarging the hardware equipment by setting a boundary line, where it is decided whether a person entered or left, to a position where the interval of persons expands at an adequate distance from the entrance.

Moreover, there is provided a device for counting the number of persons passing a gateway, in which the measuring position for finding a passage in the image is represented by a normal measuring position corresponding to the gateway in the image or a temporal measuring position (may be a plurality of positions) set at a predetermined distance from the normal measuring position, and the device further preferably further includes a measuring position setting means for selecting and setting one of the temporal measuring position and the normal measuring position based on a predetermined condition (when the store starts to open or there exist many persons), whereby the number of passing persons is counted based on the selectively set measuring position. According to this construction, even in a store such as a department store or a pinball parlor where the number of persons entering the place at the opening is quite different from that in a normal time zone, the number of entering and leaving persons may be precisely measured at both the opening time and the normal time without affection by the persons moving within the store in the normal time zone.

When many persons rush into a gateway, e.g. at store's opening time, the number of persons is measured at a temporal measuring position. When many persons pass the gateway at one time contacting each other, they are gradually dispersing as they leave the gateway. Accordingly the number of the persons may be relatively precisely measured by separating and tracing the persons on the basis of a position (temporal measuring position) at a short distance from the gateway. When the number of persons is measured on the basis of the normal measuring position corresponding to the normal gateway in a normal time zone, the number of persons actually passing the gateway is precisely detected for measurement.

In accordance with a third aspect of this invention, there is provided a management system for managing the number of entry and exit persons, which includes the above-mentioned pass person measuring device, a storage means for storing data representing the number of entry and exit persons produced by the pass person measuring device, and an analysis means for analyzing the stored data. The number of entry and exit persons is stored for each time whereby a variation or tendency for each time, day, season or longer term may be easily and precisely obtained so that sales promotion and goods in stock can be easily, quantitatively and objectively evaluated.

In accordance with a fourth aspect of this invention, the management system for managing the number of entry and exit persons may be further provided with an input means for entering variation factor data of various data which are factors varying the number of persons entering a store, in which the variation factor data are stored in the storage means together with data of the number of entry and exit persons produced by the device. Weather information and local event information is entered and stored together with the number of entry and exit persons whereby the affection to the number of entry and exit persons by weather and events can be precisely found. The variation factor data is data affecting the number of entry and exit persons, which represents weather information such as temperatures, humidity and rainfall, local event information such as a festival, an excursion, a school excursion, an examination and so forth, and sales promotion information such as advertisement and so forth.

In accordance with a fifth aspect of this invention, the management system is provided with the above-mentioned pass person measuring device, and a forecasting means for forecasting the number of entry persons based on the stored and analyzed data. Forecasting the number of entering persons may be applied to the disposition of clerks, guards, janitors and so forth so as to manage a store and a hall in good efficiency.

In accordance with a sixth aspect of this invention, the management system is provided with the above-mentioned pass person measuring device, and a sales data input means for entering sales data to analyze the relation of sales data and data of number of entry and exit persons by the analysis means. For instance, the sales data is entered through POS or the like to be reviewed with the data of the number of entry and exit persons so that there may be found, precisely, objectively, easily and in short time, such data as "no increase of sales in spite of a large number of persons entering the store" or "increase of sales in spite of a small number of persons entering the store", which may be effectively applied to the store management such as goods in stock and a layout.

In accordance with a seventh aspect of this invention, the management system is provided with the above-mentioned pass person measuring device, and a forecasting means for forecasting the number of entry persons based on the stored and analyzed data, a sales data input means for entering sales data, and a sales forecasting means for forecasting sales based on a forecasted number of entry persons, and the past stored number of entry persons and sales data. Future sales may be forecasted based on the past variations of the number of persons entering the store and sales and other information (weather or event information) to effectively manage a store or hall.

This system may be further provided with a stock data input means for entering stock data, and a stock support means for deciding recommendation of items and quantities of stock goods based on sales data and stock data which are forecasted by the sales forecasting means. A retailer having goods in stock may have a system capable of providing an advice after automatization or semi-automatization of a disposition planning about clerks and guards and a purchasing planning by applying stock data to the sales forecast for an improved management of the store.

BRIEF DESCRIPTION OF THE DRAWINGS

Other objectives and advantages of this invention will be more readily apparent from the following detailed description provided in conjunction with the following figures, of which:

FIG. 19 shows at (A) an example of input for variation factor data, and at (B) an example of an analysis result;

FIG. 22 shows a result of forecast about the number of persons;

FIG. 25 is a table showing an example of input about sales data;

FIG. 28 is a table showing an example of a result of forecast about sales;

FIG. 31 is a table showing an example of input about stock data;

FIG. 32 is a table showing an example of order data;

FIG. 34 is a table showing an operation of its decision unit;

DETAILED DESCRIPTION OF THE INVENTION

Figure 1:
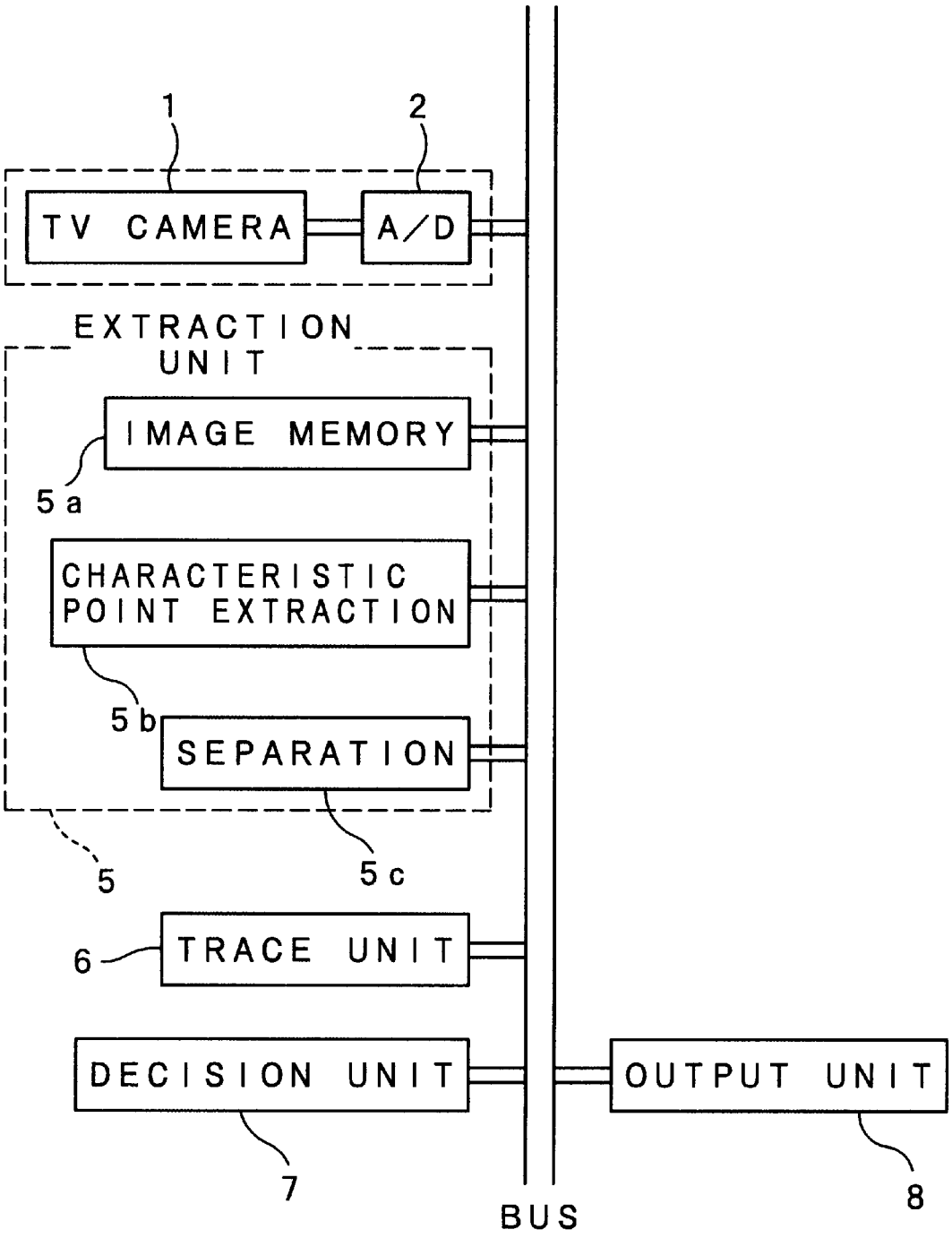
FIG. 1 is a schematic block diagram of a device as a first embodiment according to this invention.

As shown in FIG. 1, a video signal produced from a television or video camera 1 serving as a camera means is connected to a bus through an A/D converter 2. The bus is connected with an extraction unit 5 for extracting a person located in an image data taken by the camera 1, a trace unit 6 for tracing the person extracted by the extraction unit 5 based on the sequentially produced image data, a decision unit 7 for deciding whether not the extracted person has passed a decision line and whether the passage is entry or exit, and an output unit 8 outputting a decision result.

Figure 2:
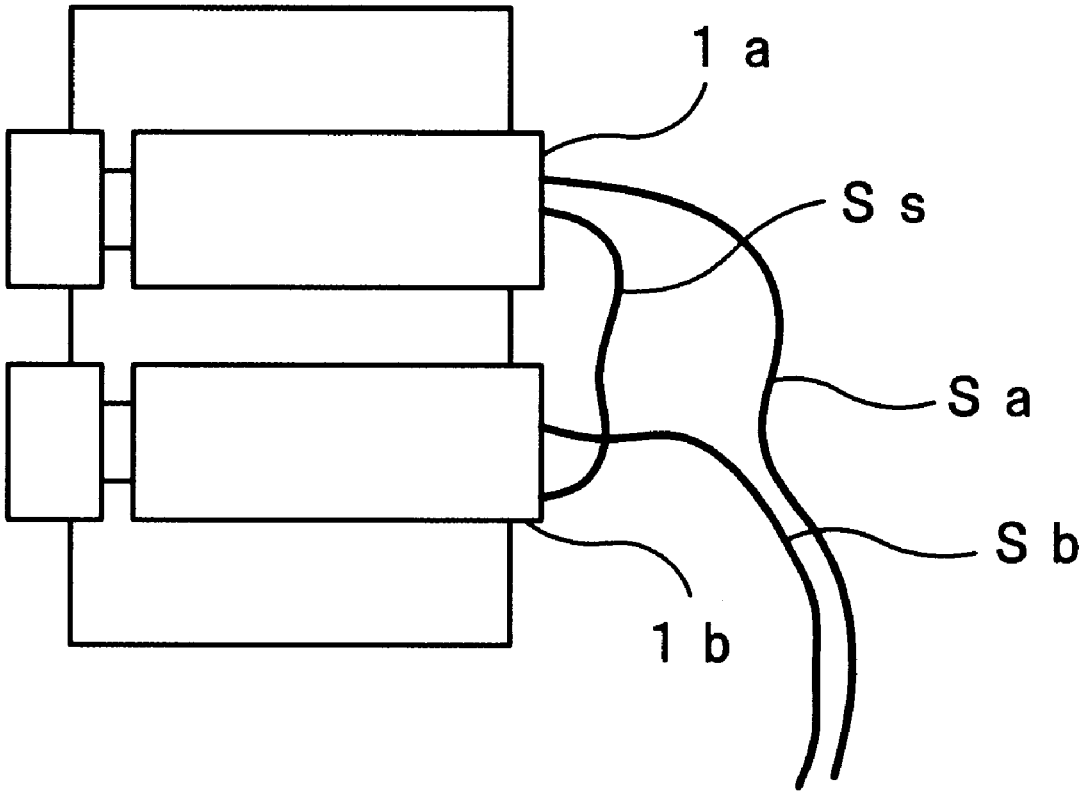
FIG. 2 is an external view of a pair of cameras as one example of a pickup means employed in the device.

The respective components will be described hereinafter. As shown in FIG. 2, the television camera 1 is practically comprised of a pair of similar cameras 1*a* and 1*b* having parallel optical axes and almost same focal distances which are respectively installed above a gateway in a direction just under the cameras or at an angle of depression. The cameras 1*a* and 1*b* are synchronized by a synchronizing signal SS so as to take an image of a measuring area at the same timing. Image signals Sa and Sb of the image taken by the cameras 1*a* and 1*b* are stored in an image memory 5*a* of the extraction unit through the A/D converter 2 and the bus.

Figure 3:
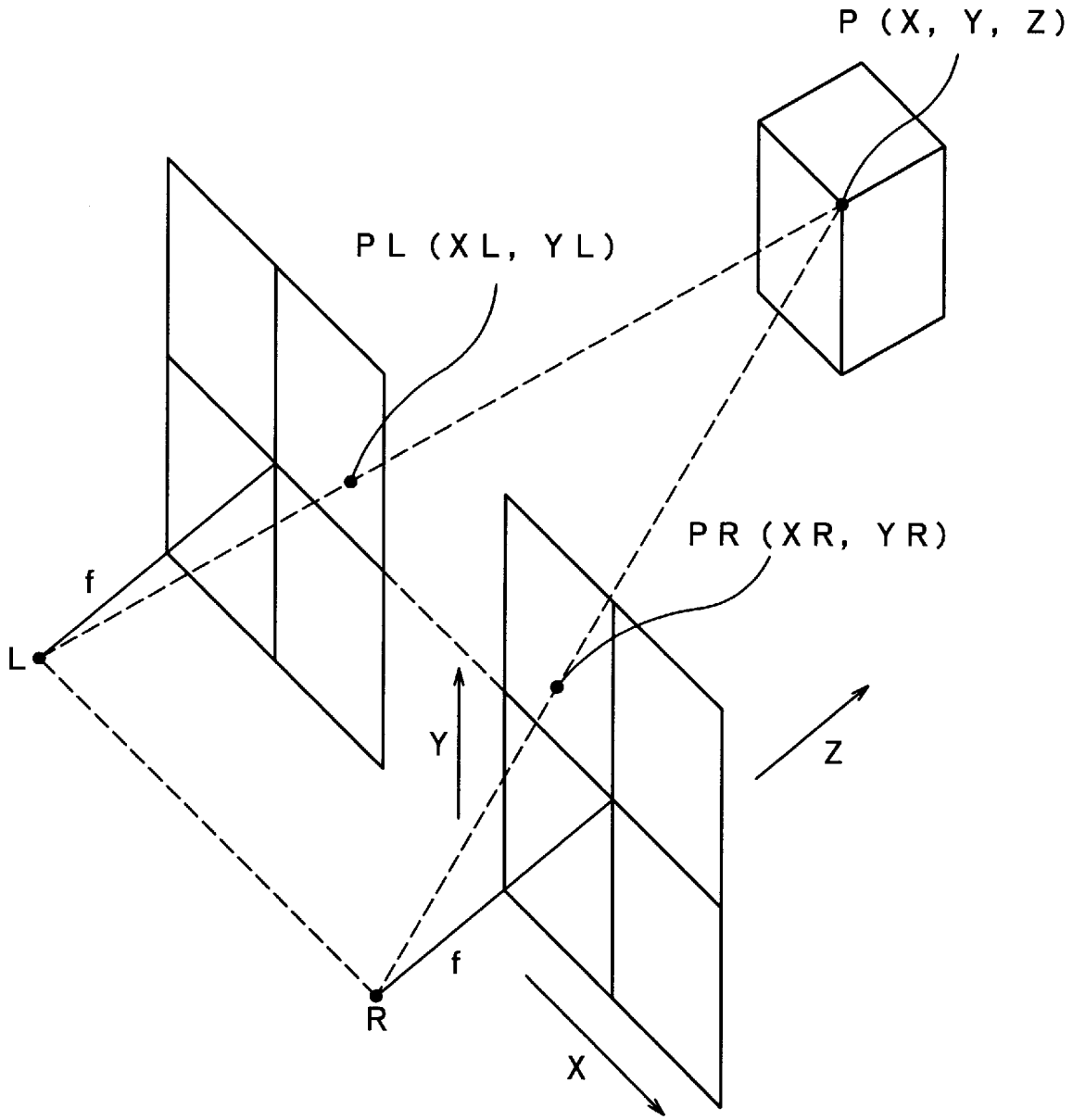
FIG. 3 an illustration explaining a theory to find space coordinates of a pickup point to be taken by the cameras.

As shown in FIG. 3, assuming that the cameras 1*a* and 1*b* are horizontally arranged (camera 1*a* is on the left side) and take the same object at a timing, a vertex P (x, y, z: three dimension coordinate (space coordinate) position in a real space) of the object is located at coordinates PL on an image taken by the camera 1*a* (L) and at coordinates PR on an image taken by the camera 1*b* (R). Thus, the coordinates on the images taken by the cameras 1*a* and 1*b* about the same object are different, and such difference is called as "parallax". The parallax becomes larger as the vertex P of the object becomes closer to the image plane (the positions L, R in the drawing). The distance to the point P can be calculated by the parallax, the focal distance of the lens, the size of the camera element, and the interval of the cameras, and the space coordinate values of the point P are calculated by the set height and angle of the cameras.

Accordingly, based on the image data of two frames taken by the cameras 1*a* and 1*b* which are stored in an image memory section 5*a,* the extraction unit 5 finds the coordinates of the respective points located in the image data, gathers the found respective points into ones constituting the respective persons, and separates the persons to find the locations of the persons.

A characteristic point extraction section 5*b* executes two processes, a first proces: characteristic points as candidate points for persons are extracted by a predetermined characteristic quantity extraction process about two frames of image data to be corresponded, and a second process: the characteristic points themselves (practically, image patterns including peripheral pixels) extracted from the two frames of image data are compared, and similar points are corresponded as ones taken about the same place (the point P in FIG. 3). Their respective concrete processes will be described hereinafter.

First Process: Characteristic Point Extraction Process

In this process the extraction section 5*b* extracts a point having large edge intensity in a predetermined area (a local area such as 4×4 pixels, 8×8 pixels) in an image, a point having a large difference against a background (a previously stored image when any pass person does not exist), and a point where there is a large difference in a plurality of images taken at a predetermined time interval. This process does not need the above-mentioned all three points, but may employ one or more of the characteristic quantity extraction processes on selection or other process.

Second Process: Characteristic Point Corresponding Process

This process decides based on the image data on one side whether or not there is any correspondence in the image data on other side. In other words, watching an image on one side, an image in a predetermined area (often the same area for deciding the characteristic points) including and around the characteristic point extracted in the former process in the watched image is cut out as a reference image, the portion having the smallest difference from the reference image in the image on the other side is extracted as a corresponding point. The extraction process extracting the portion having the smallest difference may employ a summation of absolute values of differences between the reference image and the image of an object, sum of squares, and normalized cross correlation and so forth.

In this embodiment where two cameras 1*a* and 1*b* are horizontally arranged, the coordinate values of the coordinates PL and PR on the images obtained by taking the same point P have almost same coordinates (XL and XR) in a vertical direction orthogonally intersecting the arrangement direction of the cameras. Accordingly the search object in the corresponding image to be compared with the reference image may be an area identical to or near the X coordinate of the reference image to compare the area with the reference image. Thus construction provides precise and fast correspondence.

Thus, the first and second processes execute characteristic point extraction and correspondence about a portion constituting a person to be detected. In order to measure the number of persons, eventually, one characteristic point (existing position) about one person has to be extracted and decided. A plurality of thus extracted characteristic points are determined whether they are about the same person or other person, which is executed by a separation section 5*c*.

The separation section 5*c* finds space coordinates of three dimensions based on the coordinate values of the two characteristic points corresponded in two frames of images. The three dimension coordinates of the characteristic points are obtained by three dimension measurement employing stereo images.

The obtained characteristic points are plotted on a two dimensional plane (ground plan viewed from the top) having coordinate axes of a depth direction (Z direction) and a horizontal direction (X direction) about cameras 1*a* and 1*b*. The points in a height direction (Y direction) are classified to extract the point higher than a predetermined height for extracting persons. An object in which Y axis coordinate of the extracted characteristic point is fairly low has a high possibility that it is not a person. Accordingly, the risk of extracting unnecessary data other than persons may be retroactively avoided by limitation to the points higher than the predetermined height in the Y coordinate.

Figure 4:
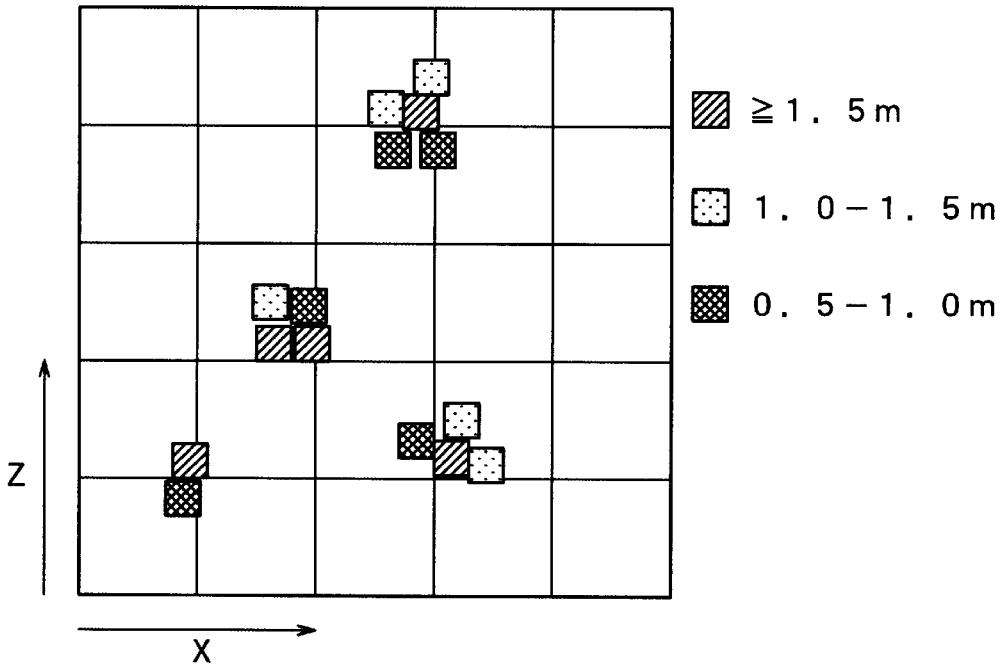
FIG. 4 shows coordinates explaining an operation by an extraction unit in the device.

In FIG. 4 there is shown an example of plotting, in which points higher than 0.5 m and existing on X and Z coordinate axes are classified into three categories 0.5–1.0 m, 1.0–1.5 m and higher than 1.5 m, respectively marked by three kinds of hatchings. Since the head is the highest in a person, the head is located in a center of the body in a ground plan. As shown in FIG. 4 a plurality of characteristic points exist within a region in a cluster, and the characteristic point in the center of the cluster is the highest. Though all points higher than 1.5 m are extracted in this embodiment, the upper limitation may be set to a predetermined value so that the characteristic points higher than the predetermined value are excluded from plotting.

A clustering process is applied to the respective characteristic points on the obtained space coordinates so that the characteristic points extracted from the same person provides one cluster and are separated from other characteristic points to be brought together. Such clustering is executed by computing distance to each data to integrate the points starting from a point having the shortest distance into one cluster, and finished when further integration is no longer available about all data. Thus, the positions of the respective clusters are regarded as the positions of persons, and the number of the clusters is regarded as the number of the persons existing within the measuring area.

Figure 5:
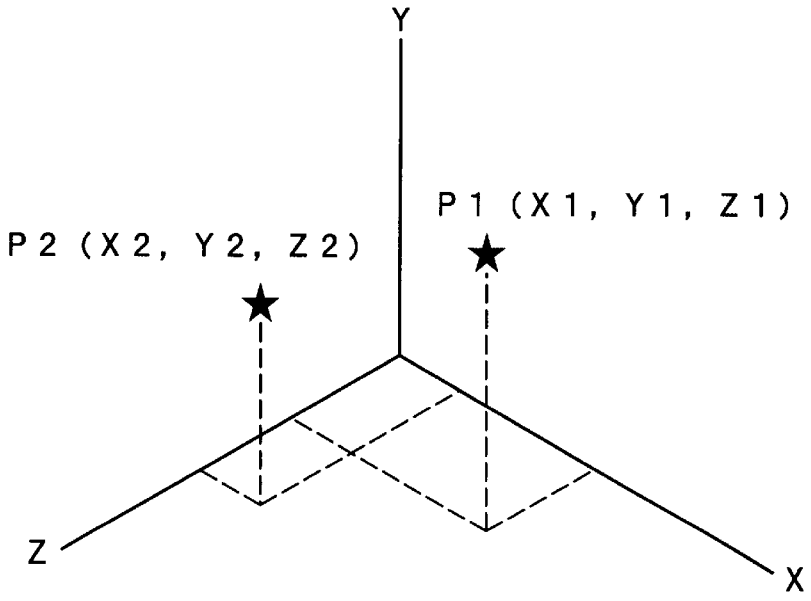
FIG. 5 shows space coordinates explaining an operation by a separation unit.

Assuming coordinate values as shown in FIG. 5, a process for evaluating a distance between respective data may employ one of the followings:

(1) a distance between space coordinates $$\sqrt{(x1-x2)^2+(y1-y2)^2+(z1-z2)^2}$$

(2) a distance between coordinate positions projected on the ground $$\sqrt{(x1-x2)^2+(y1-y2)^2}$$

(3) a distance that is the distance between coordinate positions projected on the ground added by the maximum value $$\sqrt{(x1-x2)^2+(y1-y2)^2}+\max(z1,z2)$$

or the minimum value or a mean value.

Figure 6:
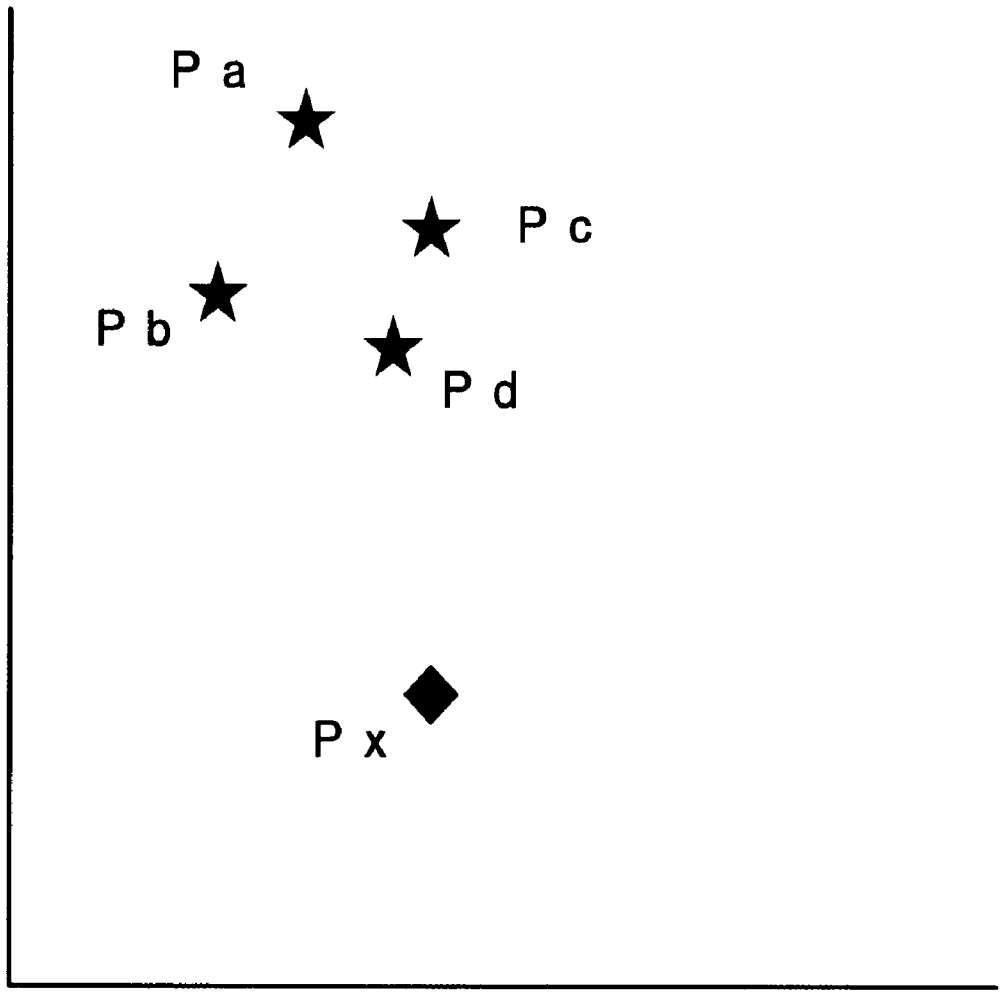
FIG. 6 is a view explaining an operation by the separation unit.

A decision process whether or not the already produced cluster shall be integrated by the data of an object to be decided (viz. the data should be included into the cluster or not) is executed by a next process. As shown in FIG. 6, when the distance between a measuring point Px and the already existing cluster (Pa, Pb, Pc, Pd) is calculated, one of the predetermined distances below is obtained. The point is added into the cluster when the obtained distance is less than a predetermined distance, but regarded as other cluster to be excluded from the cluster of the decided object when the distance is longer than the predetermined distance.

(1) To employ the center of gravity in the cluster: a distance between Px and the center of gravity from Pa to Pd in FIG. 6.

(2) To employ coordinates nearest to the data in the cluster: a distance between Pd and Px in FIG. 6.

(3) To employ coordinates farthest from the data in the cluster: a distance between Pa and Px in FIG. 6.

After thus clustering the characteristic points having distances less than the reference into clusters, a representative point is chosen therefrom to be coordinates of the existence of a person. The selection of the representative point may be executed by various methods such as choosing the characteristic point having the highest Y coordinate value (a head portion), the coordinate values of the center of gravity or a center of among a plurality of characteristic points, or one of a plurality of characteristic points belonging to one cluster. The data of thus chosen respective representative points are stored into a predetermined memory.

Figure 7A:
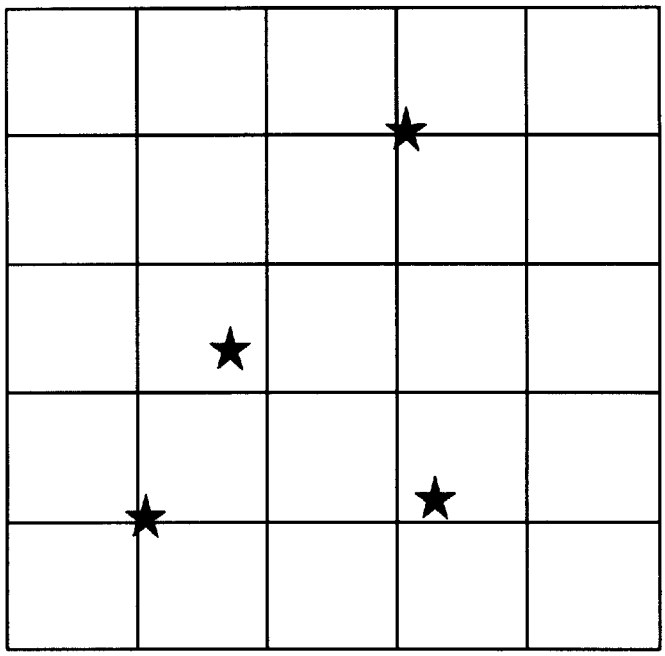
FIG. 7 shows a trace operation by a trace unit.
Figure 7B:
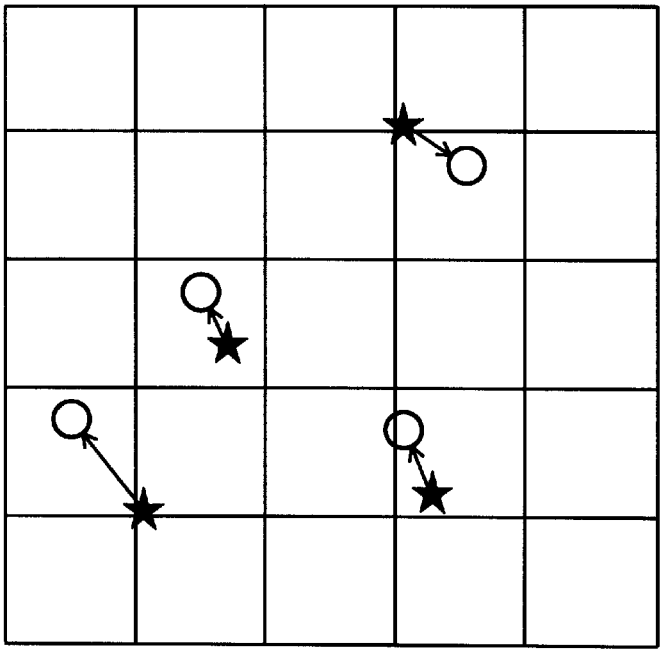

The trace unit 6 will be described hereinafter. When a result of extraction by the extraction unit 5 based on the image data taken at a time T1 is represented by star marks of FIG. 7 (A) and a result of similar extraction at the subsequent time T2 is represented by circle marks of FIG. 7 (B), the respective representative values (star marks) at the time T1 are related to the corresponding respective representative values (circle marks) at the time T2 (movement) as shown by arrow marks in FIG. 7 (B).

For the above-mentioned process, the trace unit 6 extracts the closest one to the former extraction position as a relating locus. The movement direction and speed may be forecasted by employing the former trace result or last trace results to improve the accuracy of the relation. By shortening a sampling time (much faster than the movement speed of a person), the above-mentioned simple process may control an erroneous operation retroactively. Thus obtained translation locus of each person is stored into a predetermined storage unit. The data stored with respect to the translation locus may be all of the translation locus. In this embodiment, however, the coordinates of initial and end points of each translation locus (movement line) are stored as Now the storage data to be held in relation to a decision function in a decision unit 7 as described later, whereby the storage capacity is decreased, the usage efficiency of the memory is increased, and the decision process is easily executed.

Figure 8:
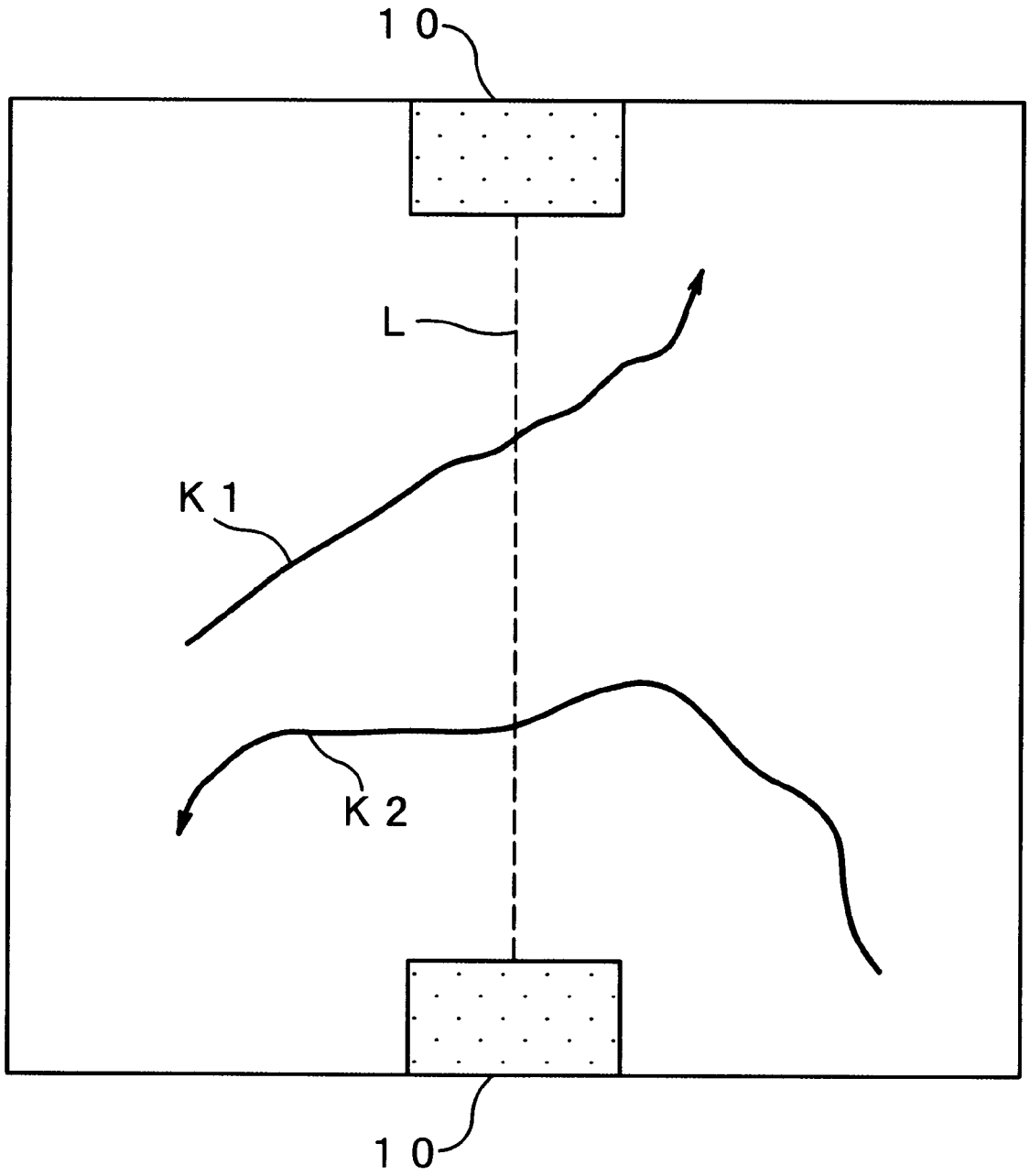
FIG. 8 shows translation loci of persons in a store to explain an operation by a decision unit.

The function of the decision unit 7 will be described. In the decision unit 7, for instance, when an image pickup area measures the number of persons passing a gateway between pillars 10, 10 in a rectangular area as shown in FIG. 8, a decision line L between the pillars 10, 10 is arranged to decide whether or not the translation locus obtained in the trace unit 6 passes (crosses) the decision line L so that the number of persons may be counted on the basis of the number of passing loci. For instance, when one person walked around the decision line L to cross the line L many times, the number of passing person is counted as one person. If it is desired to count the number of times of such crossing, the times of crossing has only to be integrated.

Figure 9:
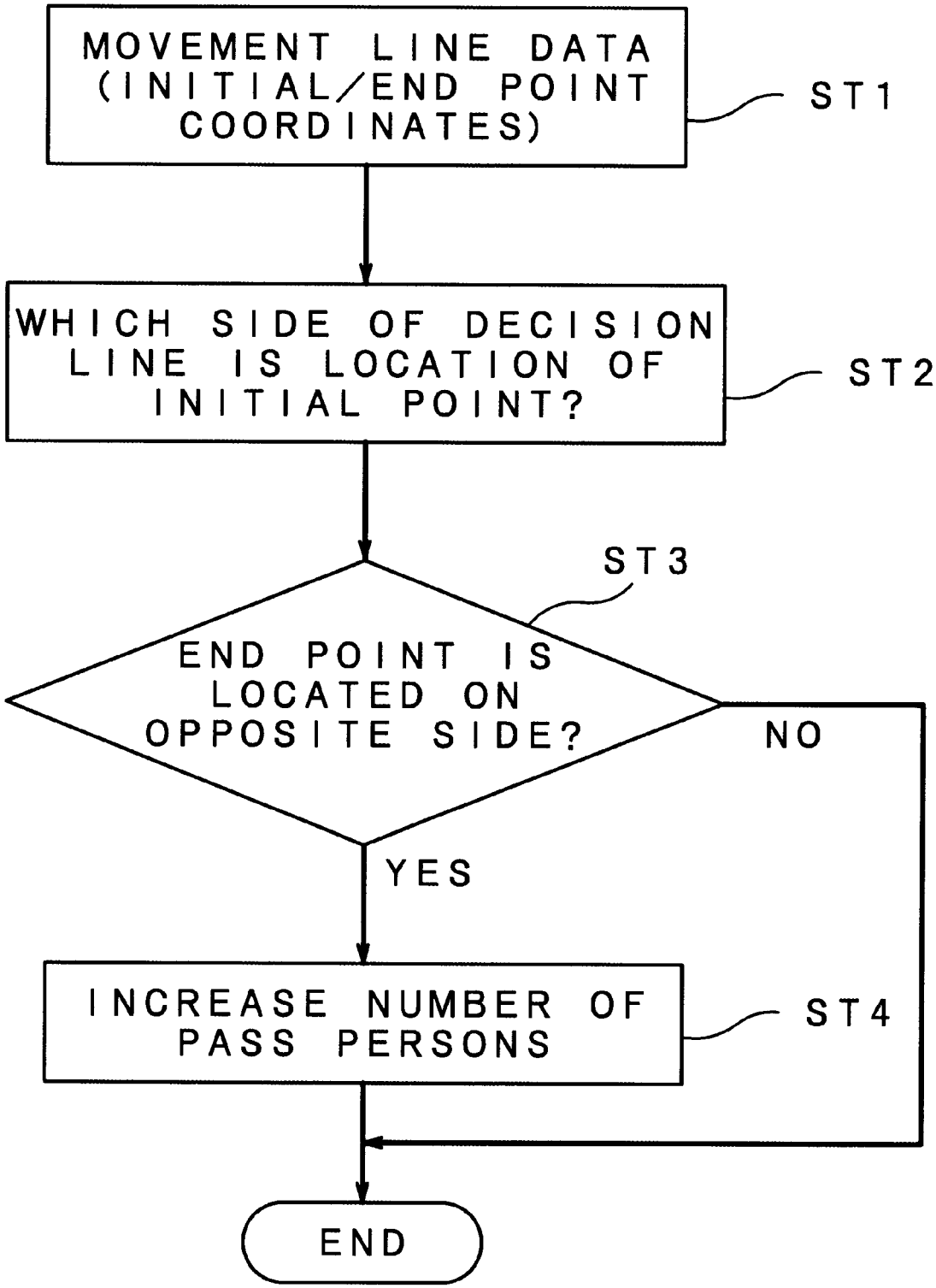
FIG. 9 is a flow chart explaining a function of the decision unit.

In this embodiment, based on the above-mentioned theory, the decision unit 7 functions a flow chart as shown in FIG. 9. Firstly the unit obtains initial point coordinates and end point coordinates of a movement or dynamic line which is the translation locus of a moving object (person) obtained by the tracing process in the trace unit 6 (a step ST1). It is inquired whether or not the initial point coordinates and the end point coordinates are respectively located on both sides of the decision line L (steps ST2 and ST3). If the initial point and the end point are respectively located on both sides of the decision line L across the same, then the decision line L is passed and the sequence moves to a step ST4 to increase the number of pass persons by "1". If both the initial and end points are located in the same area, it is decided that the person did not pass the decision line L though moved around the line, so that the number of pass persons is not increased.

As shown in FIG. 8, assuming that a gateway of a store is between pillars 10, 10, the left hand side of the drawing is the outside of the store and the right hand side is the inside, a translation locus K1 moving from the left to the right may be decided to represent an entering person and a translation locus K2 moving the right to the left may be decided to represent a person leaving the store.

Figure 10:
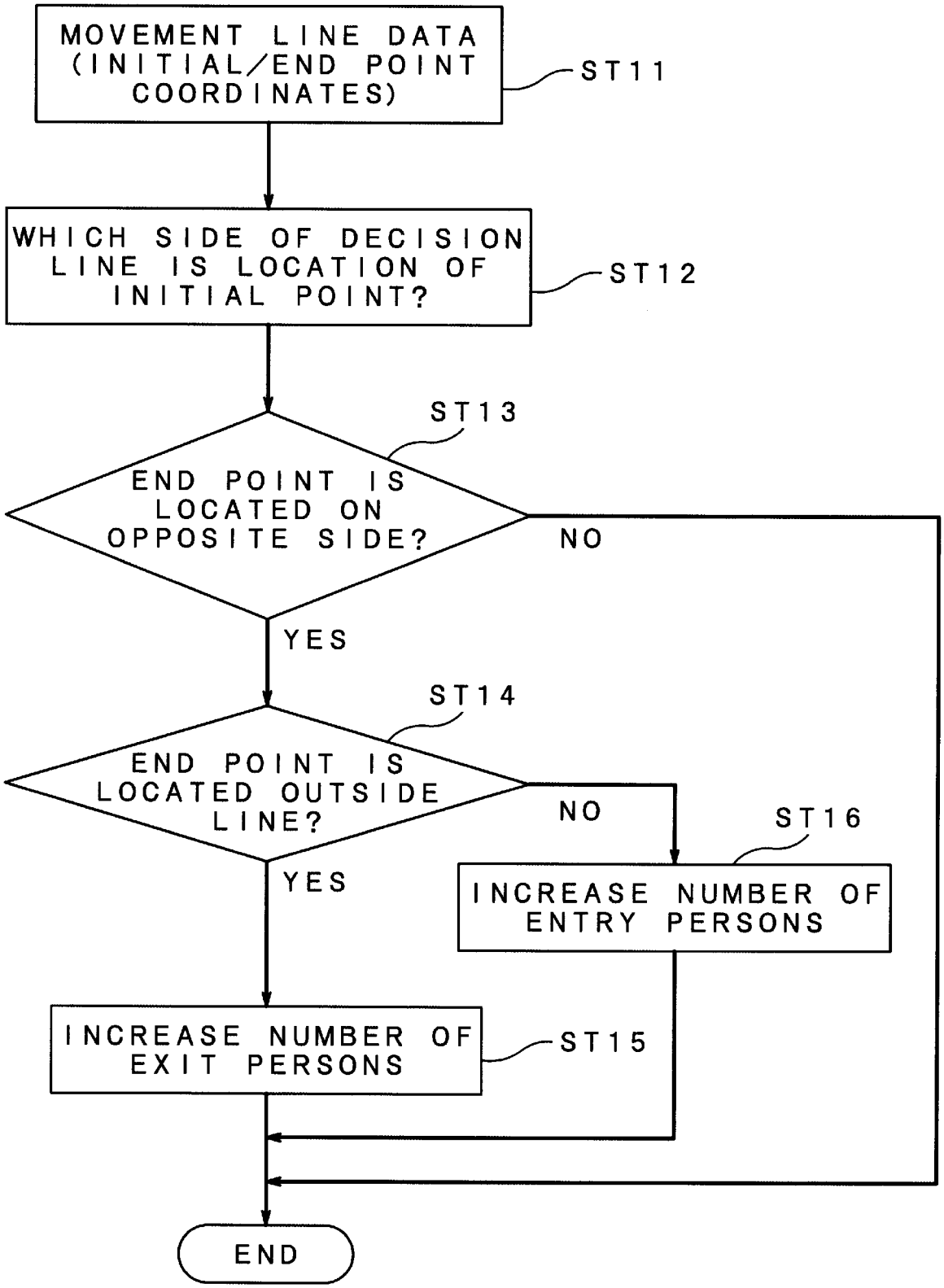
FIG. 10 is a flow chart explaining an other function of the decision unit.

If it is desired at the same time to manage the number of entering and leaving persons in addition to the counting the number of passing persons, the decision unit 7 has only to be provided with a function executing a flow chart shown in FIG. 10.

First, movement line data (coordinates of initial and end points) is obtained to decide whether or not the initial point and the end point are respectively located on the opposite sides of the decision line L crossing the same. It is decided that the decision line L has been passed when the points are located on the both side, and that the line L has not been crossed when located on the same side (steps ST11 to ST13). The sequence through this step is same as that of FIG. 9. If a NO response is produced in the inquiry step ST13, this sequence is finished like the flow chart of FIG. 9.

In this embodiment, if an YES response is produced in the step ST13, the sequence moves to an inquiry whether the passing person is an entering person or a leaving person. A movement direction is watched in this embodiment, and it is decided which side of the decision line L is located by the end point coordinates. If the end point is located on the outside (the outside of the store), the passing person is regarded as an exit person who left from the inside of the store and the number of exit persons is increased by "1" (steps ST14, ST15). If the end point is located on the inside of the decision line (the inside of the store) to the contrary, the passing person is regarded as an entry person who entered from the outside to the inside of the store and a NO response is produced from the inquiry step ST14 to increase the number of entry persons by "1" (steps ST14, ST16).

If the entrance and the exit are commonly located, the number of entry and exit persons is precisely measured by employing the function shown in FIG. 10. When the entrance is separated from the exit or the number of persons passing a passage is requested to be simply measured, the function of FIG. 9 is preferable because of simple processing.

The output unit 8 is comprised of a monitor, a printer and so forth to output the number of persons finally obtained in the decision unit 7. If desired, it may display images produced in the middle of the processing such as an image taken by video camera 1, image data stored in the image memory, and translation locus.

Figure 11:
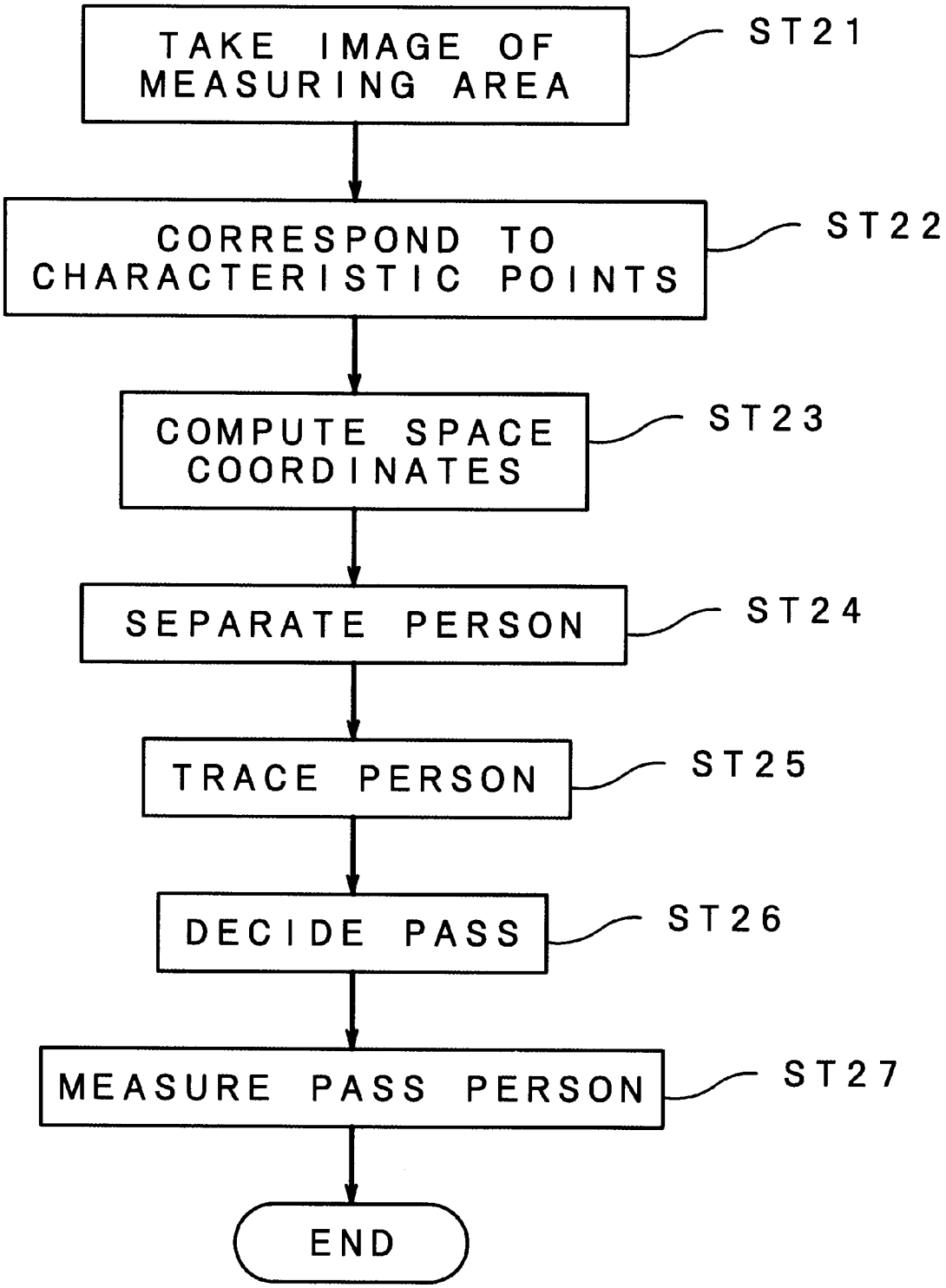
FIG. 11 is a flow chart explaining one example of a method according to this invention.

An operation of the device of FIG. 1 will be described hereinafter. As shown in FIG. 11, a measuring area is taken at the same timing by the pair of cameras synchronously driven to obtain stereo image data (a step ST21).

Based on two frames of the obtained image data, characteristic points of the respective pixels are extracted and the extracted points are corresponded each other (a step ST22). Moreover, based on the coordinates of the characteristic points existing in the two corresponded images, their coordinate values are computed in a space coordinate system (a step ST23) and the persons are separated (a step ST24). The characteristic points having close coordinate values in the space coordinate system are clustered to the same cluster to separate the persons and to assign the representative coordinate values to the respective clusters. Thus process from step ST22 to step ST24 is executed in the extraction unit 5.

Next, the positions of the characteristic points (persons) in the space coordinate system obtained by taking an image are stored for each frame to trace a movement of each person (a step ST25). This trace process continues from the appearance of the respective persons to their disappearance wherein the coordinates of initial and end points are stored in pairs. This process is performed in the trace unit 6.

In the decision unit 7, whether the decision line was passed or not is decided on the basis of the coordinates of the initial and end points, and the number of passing persons is counted to measure the number of the persons (steps ST26, ST27).

In this embodiment the space coordinate values of the characteristic points are computed based on the stereo images taken by the pair of cameras 1*a* and 1*b*, and persons are separated into individuals by clustering on the basis of the space coordinate values, so that the overlap of persons in a depth direction (Z axial direction) may be separated and the counting operation is precisely performed.

Since the stereo image process is employed in this embodiment, the function of this device is little affected by sunlight variations, puddles in rain or the like, and the decision line may be arranged in an area having no ceiling by installing the cameras in a slant direction from a gateway with easing the installation conditions.

Figure 12A:
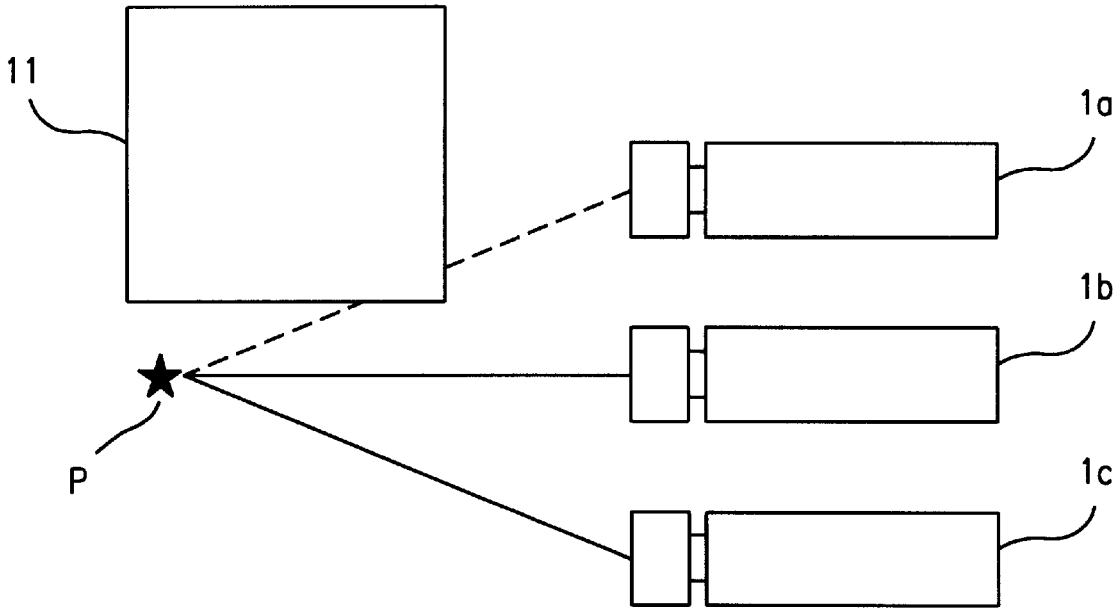
FIG. 12 shows external views of a modification of the pickup means of FIG. 1.
Figure 12B:
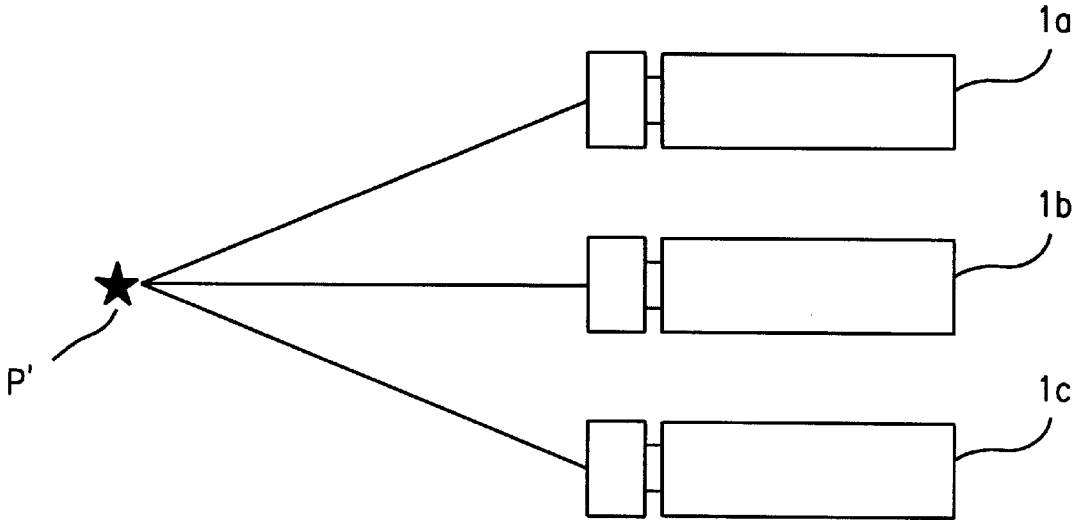

Though the video camera 1 is represented by the pair of cameras 1*a* and 1*b* in this embodiment, this invention is not limited thereto and three or more cameras may be employed if desired. As shown in FIG. 12 (A), when three cameras 1*a*, 1*b* and 1*c* are employed and an obstacle 11 exists in a pickup area of the camera 1*a* as shown in a dotted line, the camera 1*a* cannot take an image about an object P, so that the parallax cannot be obtained in the above-mentioned two camera pickup way and the extraction of a person fails. However, the object P is taken by other two cameras 1*b* and 1*c* to provide a parallax based on the taken images for computing the coordinate values in a space coordinate system. Accordingly the dead angle is decreased, and more precise measurement can be expected.

The correlation of three images may provide a space coordinate value. For instance, as shown in FIG. 12 (B), plural optional pairs of cameras (cameras 1*a* and 1*b*, cameras 1*b* and 1*c*) are chosen to specify the space coordinate position of a characteristic point P' based on the stereo image taken by one pair of cameras (1*a* and 1*b*) and also specify the characteristic point P' so that space coordinate values may be computed based on the respectively specified coordinate values. There is not only a risk of the above-mentioned dead angle by obstacles but also a risk of failure of trace in the trace processing. When the space coordinate values of a characteristic point are obtained based on two pairs of stereo images, however, such a risk of failure may be retroactively decreased for an improved measurement with a better accuracy. If desired, the decision of "genuine" may be made when the same (close) positional space coordinate values are extracted based on the stereo images obtained by the two pairs of cameras.

Figure 13:
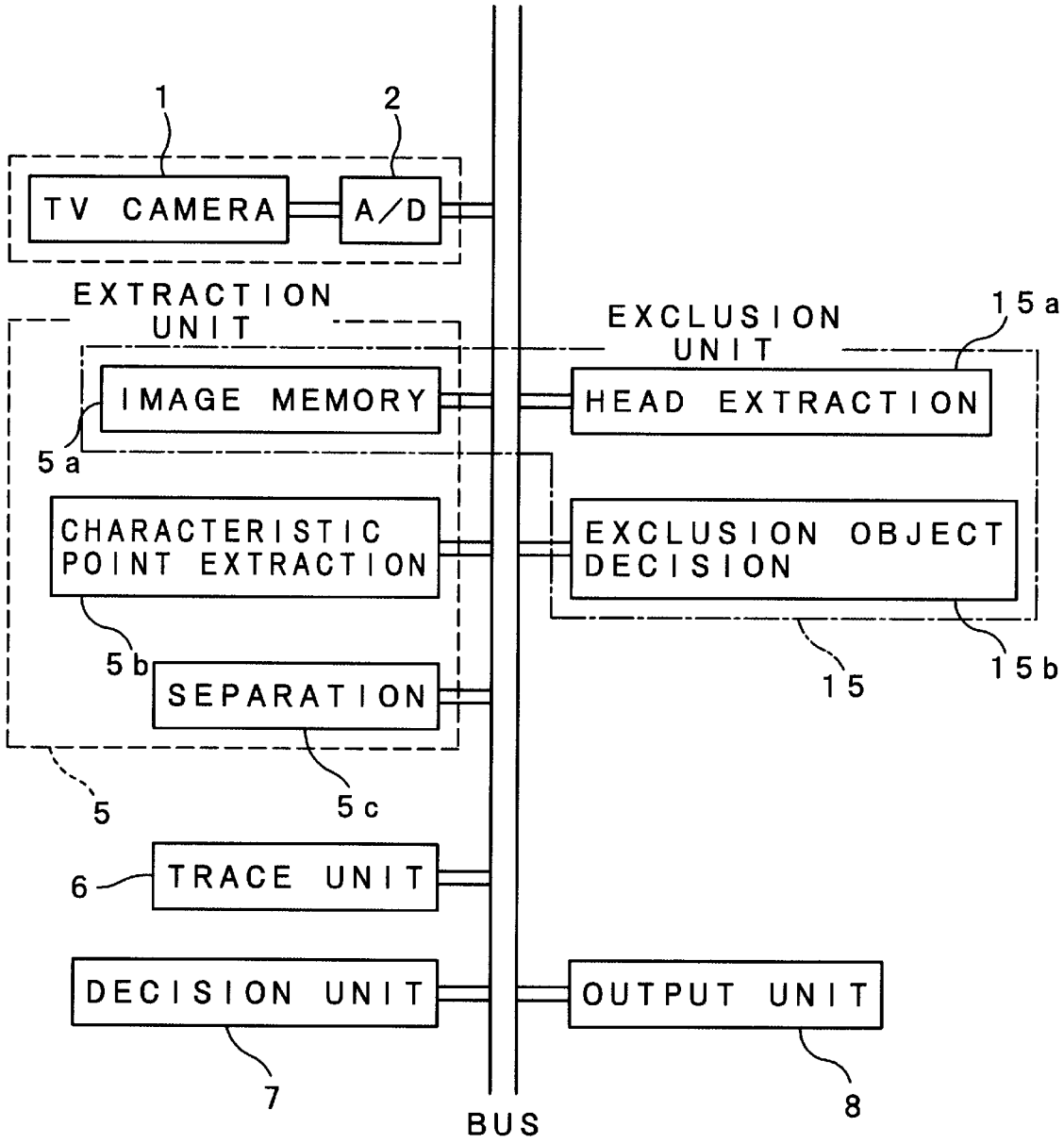
FIG. 13 is a schematic block diagram of a device as a second embodiment of this invention.

In FIG. 13 there is shown a second embodiment of this invention. This embodiment is based on the first embodiment, and further provided with an exclusion function about a particular person. As shown in FIG. 13 the bus is associated with an exclusion unit 15 for prohibiting the increase of the number of passing, entering and leaving persons when the persons separated and extracted in the separation unit 5 satisfy a predetermined condition. For instance, even if the decision line is passed by clerks, janitors and so forth other than visitors to the store, the number of entry and exit persons is not increased, whereby a correct number of visitors can be obtained with increasing the information value about the measurement results.

The persons to be excluded from counting wear clothing having a sign. When persons are separated, a predetermined image processing is applied to an image area section on which the person exists to decide if there exists the above-mentioned sign in the person. If exists, the person is regarded as the person to be excluded and the number of persons is not increased. The sign may be designed to be a cap or uniform with a particular color pattern.

For the above-mentioned processing the exclusion unit 15 is provided with a head extraction section 15*a* and an exclusion object decision section 15*b*. In this embodiment the persons to be excluded have yellow colored caps on. The head extraction section 15*a* obtains Y coordinate values of a space coordinate system about the respective characteristic points after specifying the positions of persons, estimates that the portion around the highest coordinates in the characteristic point data classified to persons is a head portion, and extracts image data existing in an area having a predetermined size around the coordinates corresponding to the head in the image data taken by one of the cameras so as to be applied to the exclusion object decision section 15*b*.

The exclusion object decision section 15*b* applies a predetermined image recognition processing to given image data, and turn ON an exclusion flag to be added to the dynamic line data obtained by trace when the sign for exclusion is observed in the image data (area). Since the sign is yellow colored caps in this embodiment, an yellow colored pixel is extracted and the characteristic quantity, such as its size, area and shape, is extracted to be compared with the reference data of the sign for deciding whether it is proper. The decision process itself may employ conventional various recognition processes.

Figure 14:
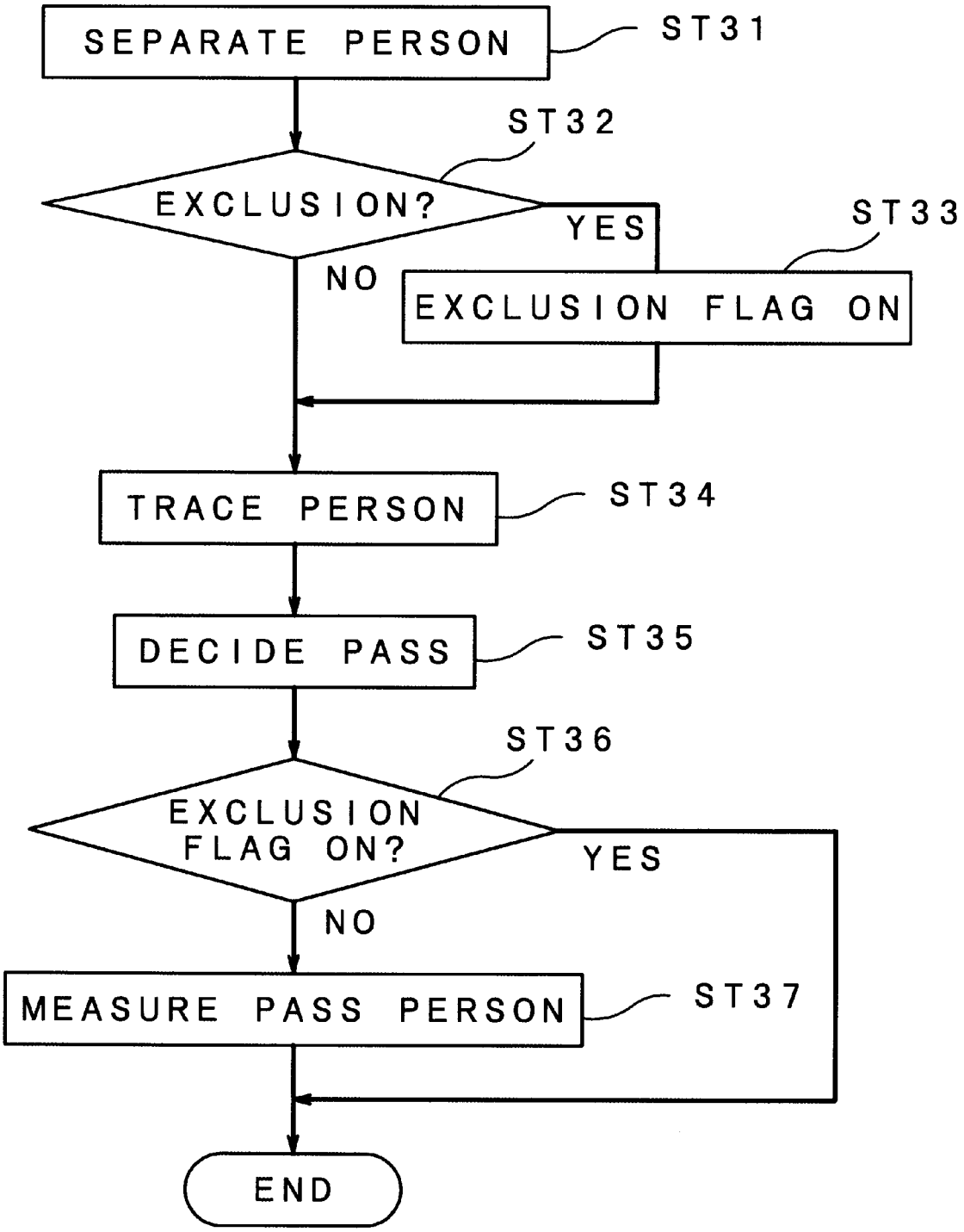
FIG. 14 is a chart explaining a flow of data in the second embodiment.

In FIG. 14 there is shown a flow chart according to one example of the process of this embodiment. A same process as that of the first embodiment is executed, and the extraction unit 5 executes the separation of persons (a step ST31). Then, the execution unit 15 is activated to obtain the space coordinates of the clustered characteristic points constituting the respective persons to find the coordinates of the head portion as a sign, and to obtain image data around the head portion by accessing the image memory section 5*a*. Whether or not the person should be excluded from object is decided by deciding whether or not there exists the sign.

If the sign of the exclusion object is not found, the person should not be excluded and it is enquired by executing steps ST34 and ST35 if the decision line has been passed. If the person should not be excluded, a NO response is produced from an inquiry step ST36 and applied to a step ST37 where the number of persons is increased.

If the person is decided to be an exclusion object in the step ST32, an exclusion flag is set to ON and added to movement or dynamic line data obtained by tracing (a step ST33). Though the trace process and the pass decision process are executed, an YES response is produced in the step ST36 if the exclusion flag is ON after the trace, whereby the step ST37 is skipped and the number of persons is not increased.

The other construction, operation and advantages are the same as those of the first embodiment, so that the same reference numbers are applied and their details are omitted for a simplified explanation. The pass decision process (step ST35) and the process measuring the number of pass persons (step ST37) may be modified to measure the number of entry and exit persons as described in the modification of the first embodiment.

In this embodiment the decision of trace and pass is executed irrelevantly whether the object should be excluded or not, and such exclusion is done when the number of persons is increased in a final step. This invention is not limited to this embodiment, and may be modified to stop the subsequent trace when a person to be excluded is found.

As another modification of this embodiment, a card reader for checking the entry and exit of persons may be employed to request an excluded person to scan a card through the card reader so that the number of pass persons is not increased in the decision units if the card is entered. A non-contact card may have a same effect.

Figure 15:
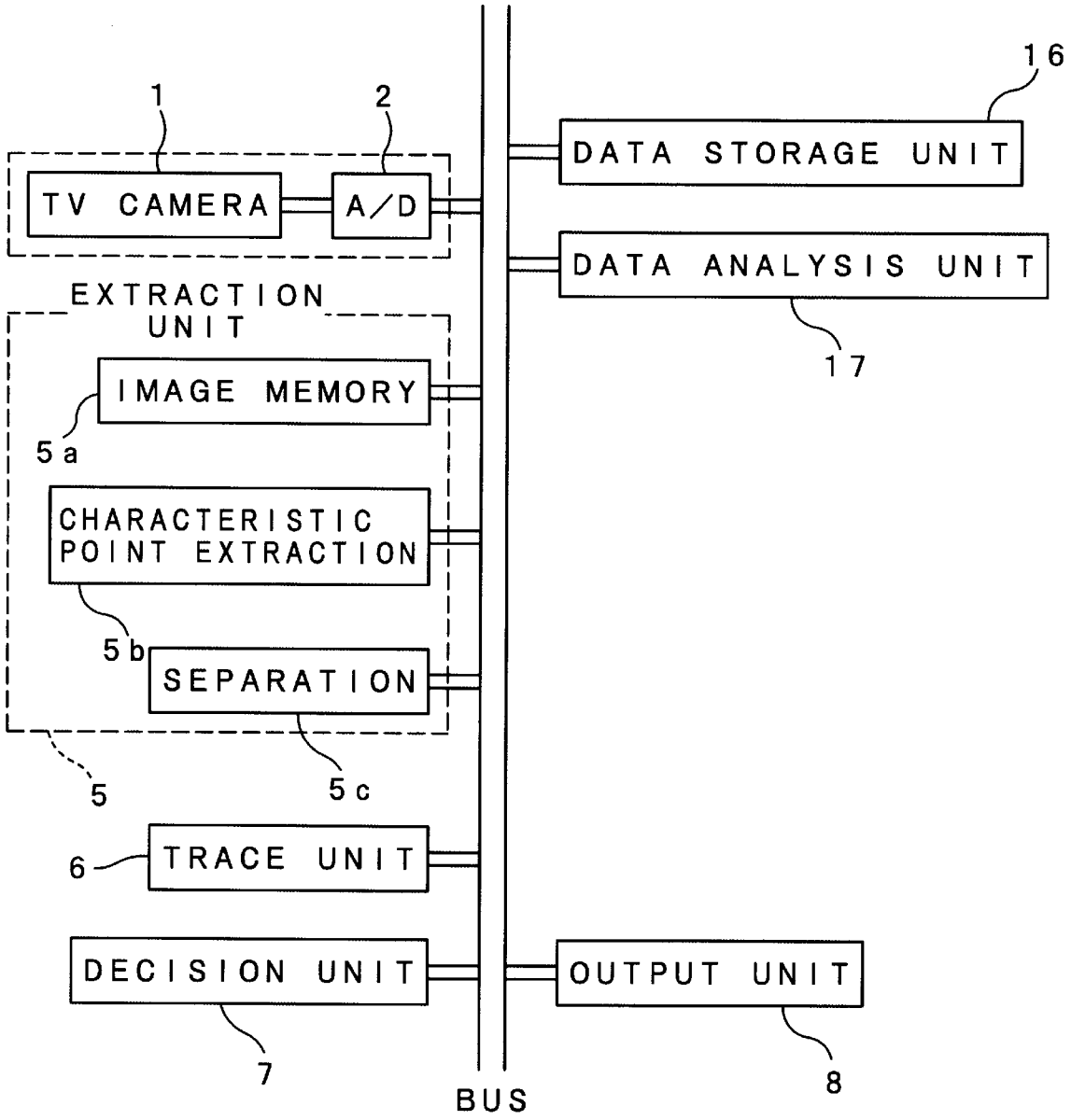
FIG. 15 is a schematic block diagram of a device as a third embodiment of this invention.
Figure 16:
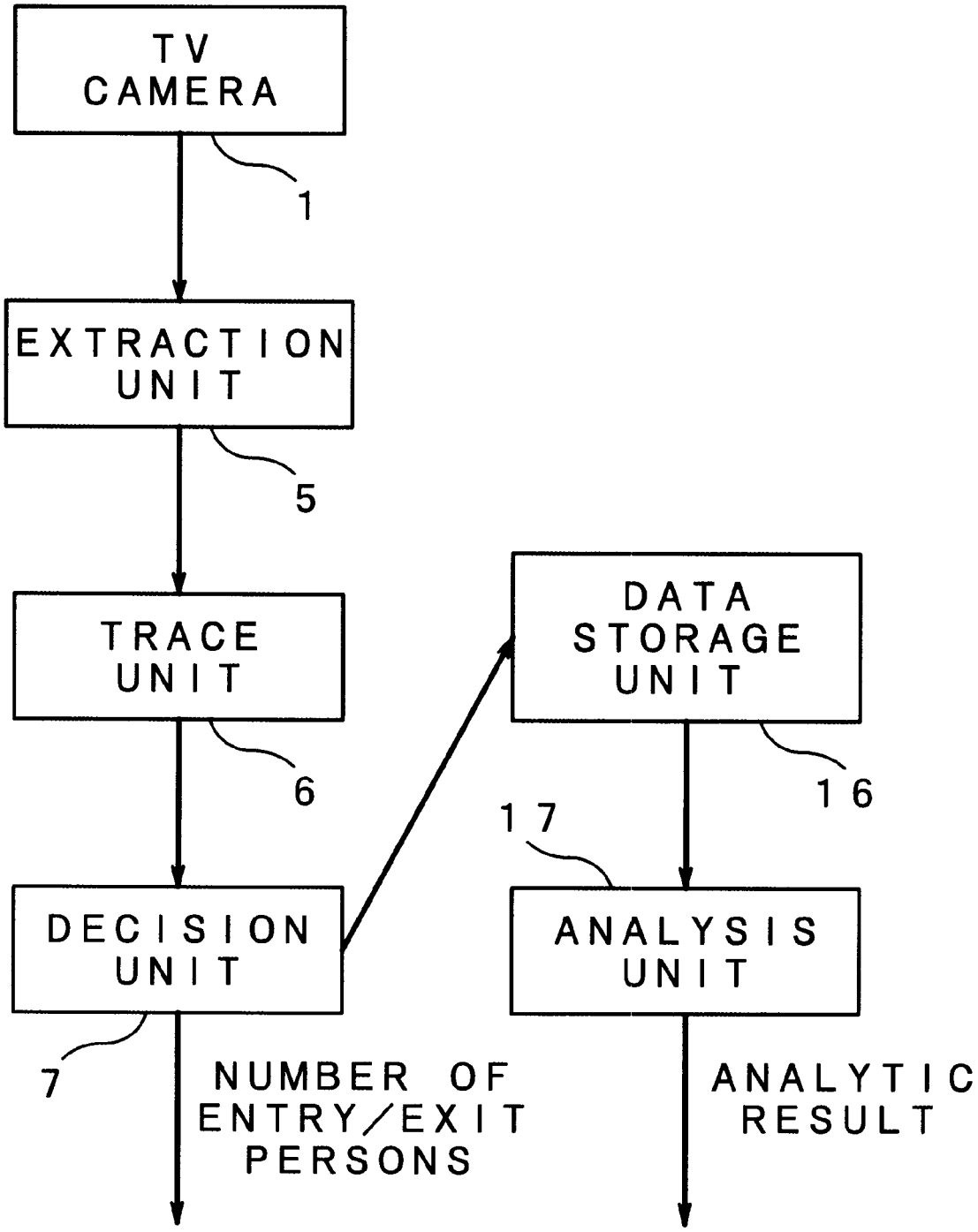
FIG. 16 is a chart explaining a flow of data in the third embodiment.

FIG. 15 shows a third embodiment of this invention, and FIG. 16 shows a data flow of the embodiment. This embodiment is based on the first embodiment. The bus is further connected with a data storage unit 16 employing a hard disk, an optical magnetic disk or the like, and a data analysis unit 17 for performing a predetermined analysis based on the data stored in the data storage unit 16.

The storage unit 16 is designed to store the number of entry and exit persons for each unit time and the measuring time. In decision unit 7 the separation of persons is performed based on the above-mentioned stereo image, the number of persons or entry-and-exit persons passing a decision line is obtained. The components (data flow) in a vertical line on the left side in FIG. 16 are the same as those of the first embodiment, and their detailed explanation is omitted.

In this embodiment the data of the number of entry and exit persons which is produced from the decision unit 7 is applied to output unit 8 and the data storage unit 16. The unit 16 stores the applied number of entry and exit persons together with time or calendar data such as a timer or clock installed in a computer.

The data analysis unit 17 seeks, based on the data stored in the data storage unit 16, a time distribution such as the number of entering and leaving persons or the number of staying persons [(The cumulative total of entering persons)−(The cumulative total of leaving persons)] a day, the tendency of the number of entering and leaving persons for each time period such as a day of the week, a holiday or a season. A result of the analysis is applied to output unit 8 for display on a monitor or printout, but may be stored in the storage unit. The unit 17 may analyze periodically at a predetermined timing, unperiodically upon an external instruction, or both periodically and unperiodically. The external instruction may be entered by an entry device, such as a keyboard, mouse and the like which are not shown in drawings.

Thus construction may statistically teach a day of the week or time zone when there are many visitors or when there are many persons are staying within a store, which is useful data for future sales planning and sales strategies. Since other construction and effects are the same as those of the foregoing embodiments, the same reference numbers are applied to this embodiment and the detailed explanation is omitted.

Figure 17:
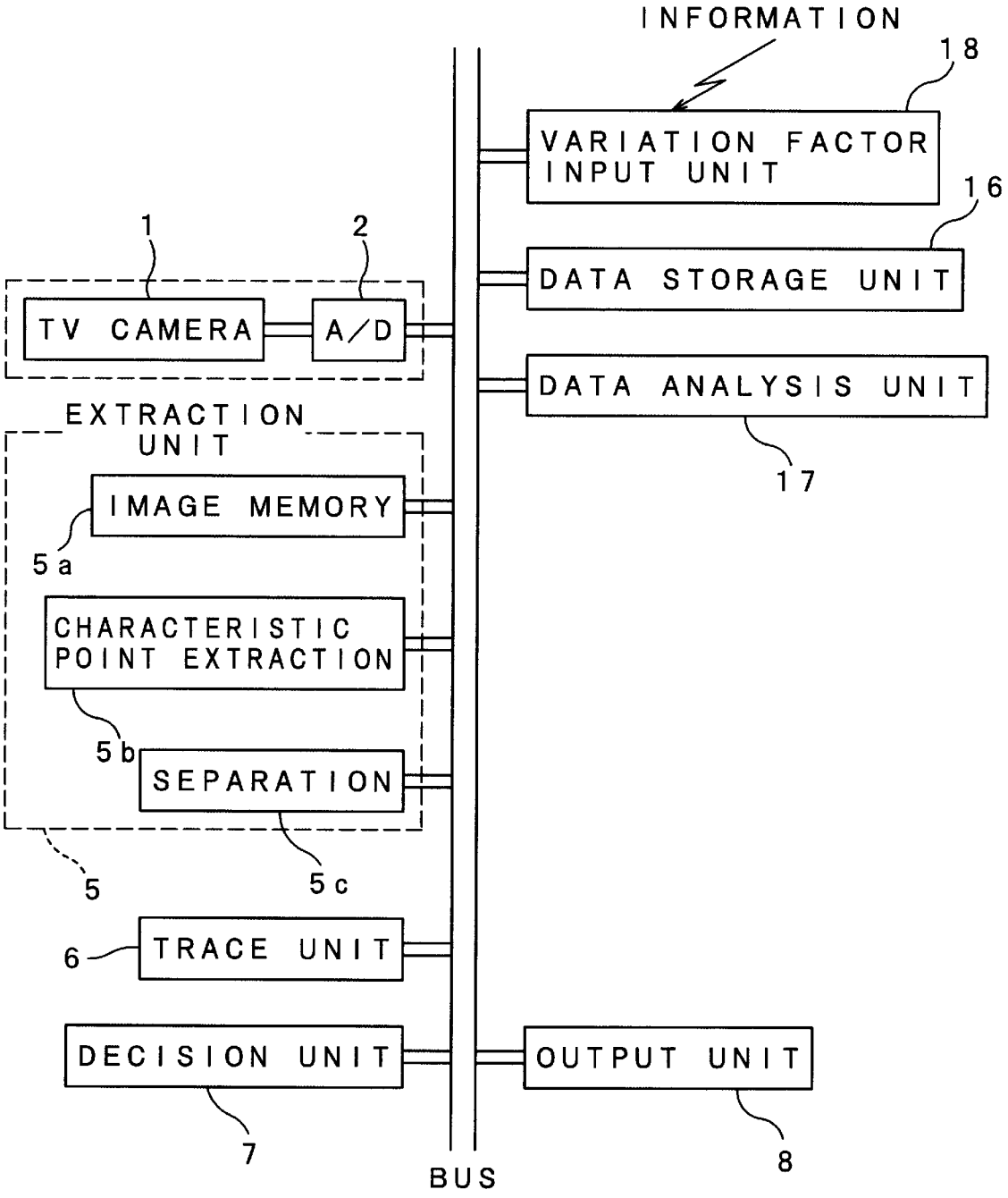
FIG. 17 is a schematic block diagram of a device as a fourth embodiment of this invention.
Figure 18:
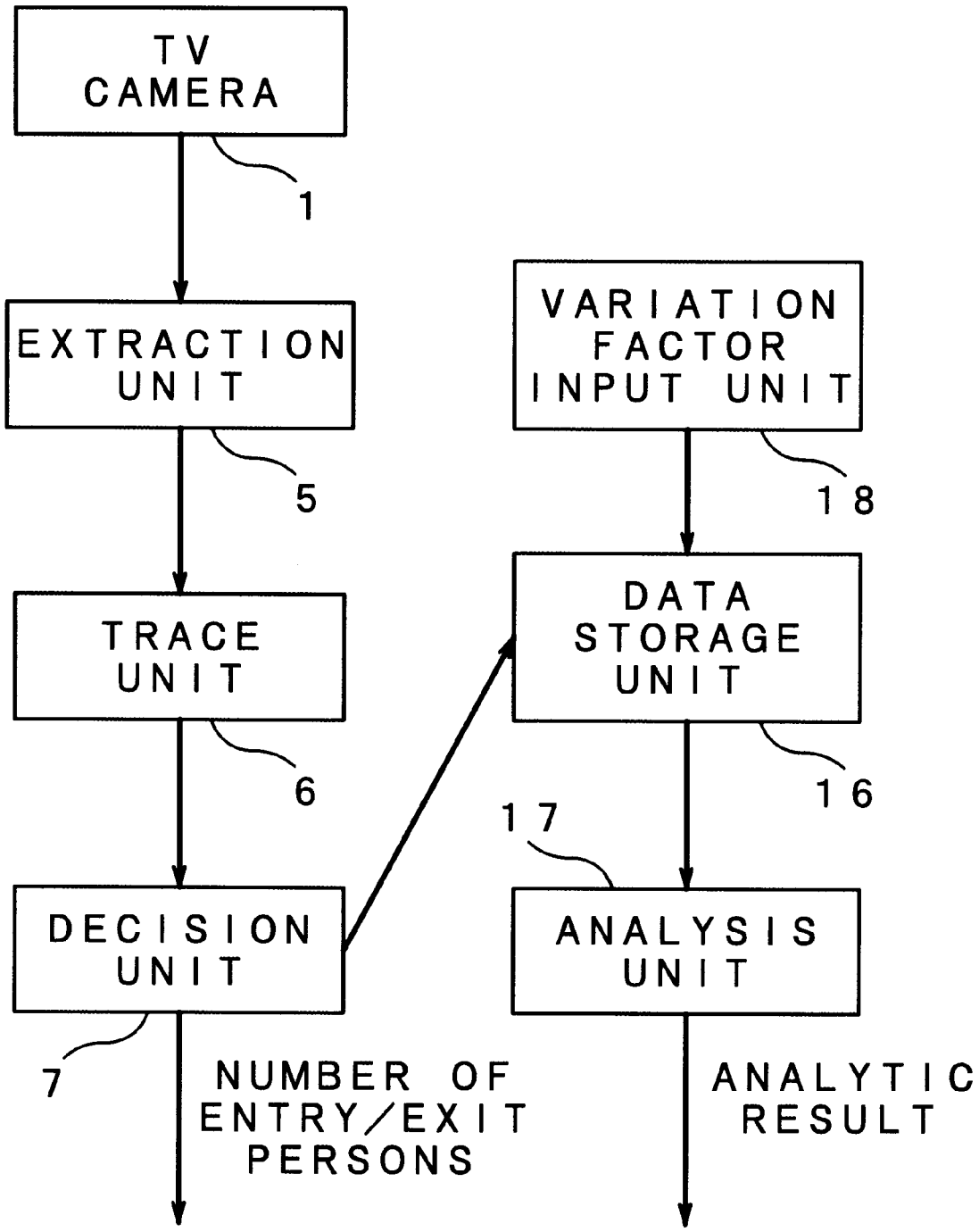
FIG. 18 is a chart explaining a flow of data in the fourth embodiment.

In FIGS. 17 and 18 there is shown a fourth embodiment of this invention. FIG. 17 shows a construction of this embodiment, and FIG. 18 shows a data flow thereof. This embodiment is based on the third embodiment, in which the bus is further connected with a variation factor input unit 18.

Data storage unit 16 stores the number of entry and exit persons applied from the decision unit 7 and the time and calendar information applied from an installed clock together with variation factor data related therewith.

The variation factor herein means data affecting the number of visitors to a store, such as weather information of temperatures, humidity, rainfall and so forth, local event information of a festival, an excursion, a school excursion, an examination and so forth, and sales promotion information of advertisement and so forth. Such data may be entered manually by a clerk or automatically by a sensor or an on-line data base. The variation factor input unit 18 is a component such as a keyboard which manually enters data by a clerk, an output of various sensors, or a receiver which receives data transmitted from other data base.

FIG. 19 shows at (A) an example of an input of the variation factor data wherein a weather, a humidity (and/or temperature), a sales promotion and local information may be manually entered for each date and time through an input device such as a keyboard by an operator. For example, the humidity may be an output which is automatically provided by a humidity sensor as a predetermined time comes.

The data analysis unit 17 of this embodiment collects the data stored in data storage unit 16 on the basis of a predetermined reference to be applied to output unit 18, like the third embodiment. Since the data of the variation factors is stored in addition to the information of the number of entry and exit persons, the average number of entering persons and staying persons on a day of the week may be found, and the number of persons for each date and time is compared with the average number to extract the difference larger than a predetermine level to be outputted together with the variation factors. The relation with the variation factors may be analyzed upon the instruction by the operator. For instance, when the correlation with rain is desired, analysis is performed about "rain" as a key to compare the number of persons in rain with the mean value.

FIG. 19 (B) is a table showing an example of an output, wherein the average numbers of visitors (entry persons) are obtained for each time zone of each day of the week such as weekday (Monday through Thursday), Friday, Saturday and Sunday and shown in a table. As a result of analysis, it is learned that the number of persons is decreased by 15% in case of rain, and shown above the table.

The "difference" from the above-mentioned mean value may be not only a simple difference (deviation) of persons but also a ratio as shown in the illustrated example. Thus, the relation between the variation factor and the number of visitors is found. Since other construction and effects are the same as those of the foregoing embodiments, the same reference numbers are applied to this embodiment and the detailed explanation is omitted.

Figure 20:
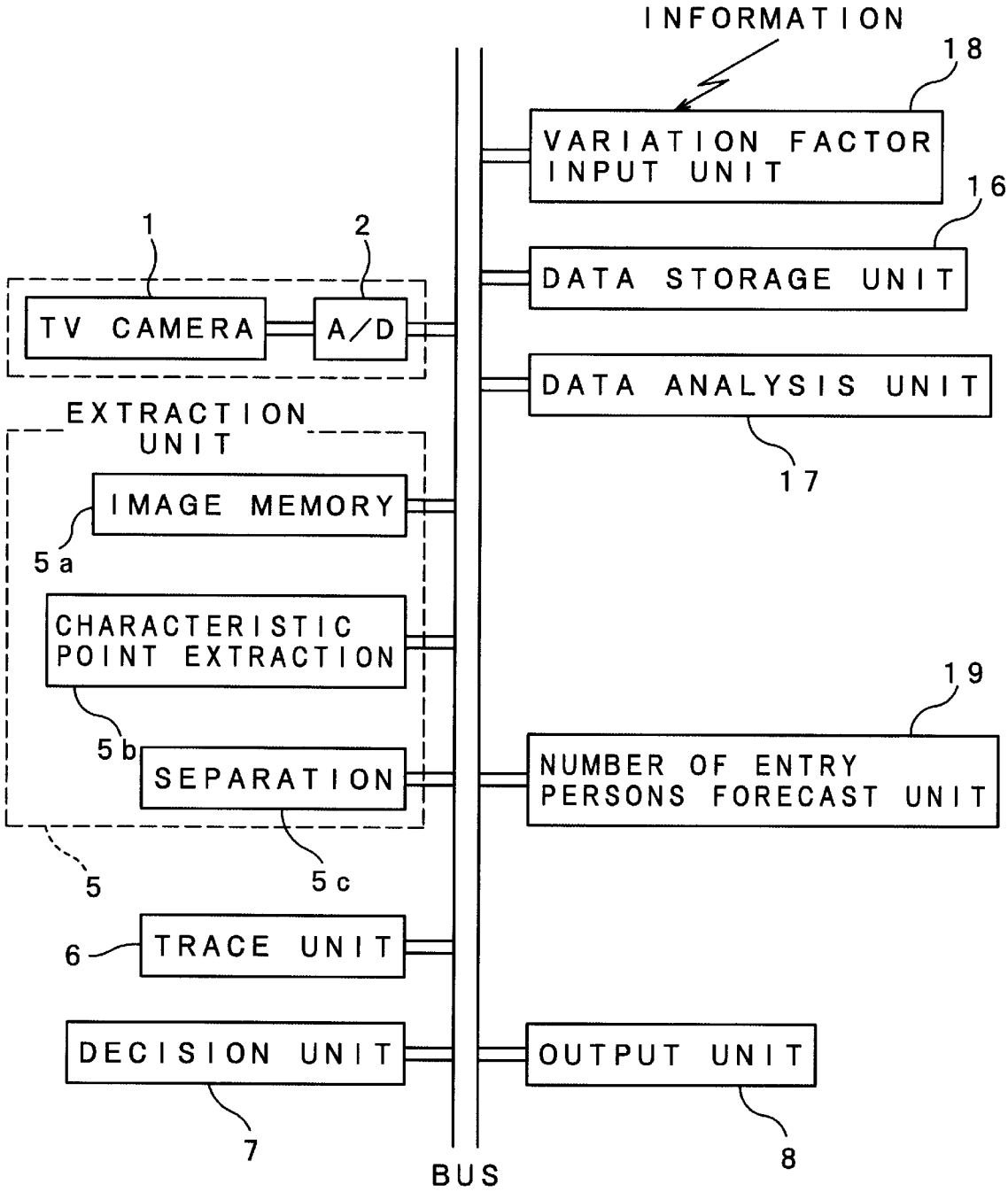
FIG. 20 is a schematic block diagram of a device as a fifth embodiment of this invention.
Figure 21:
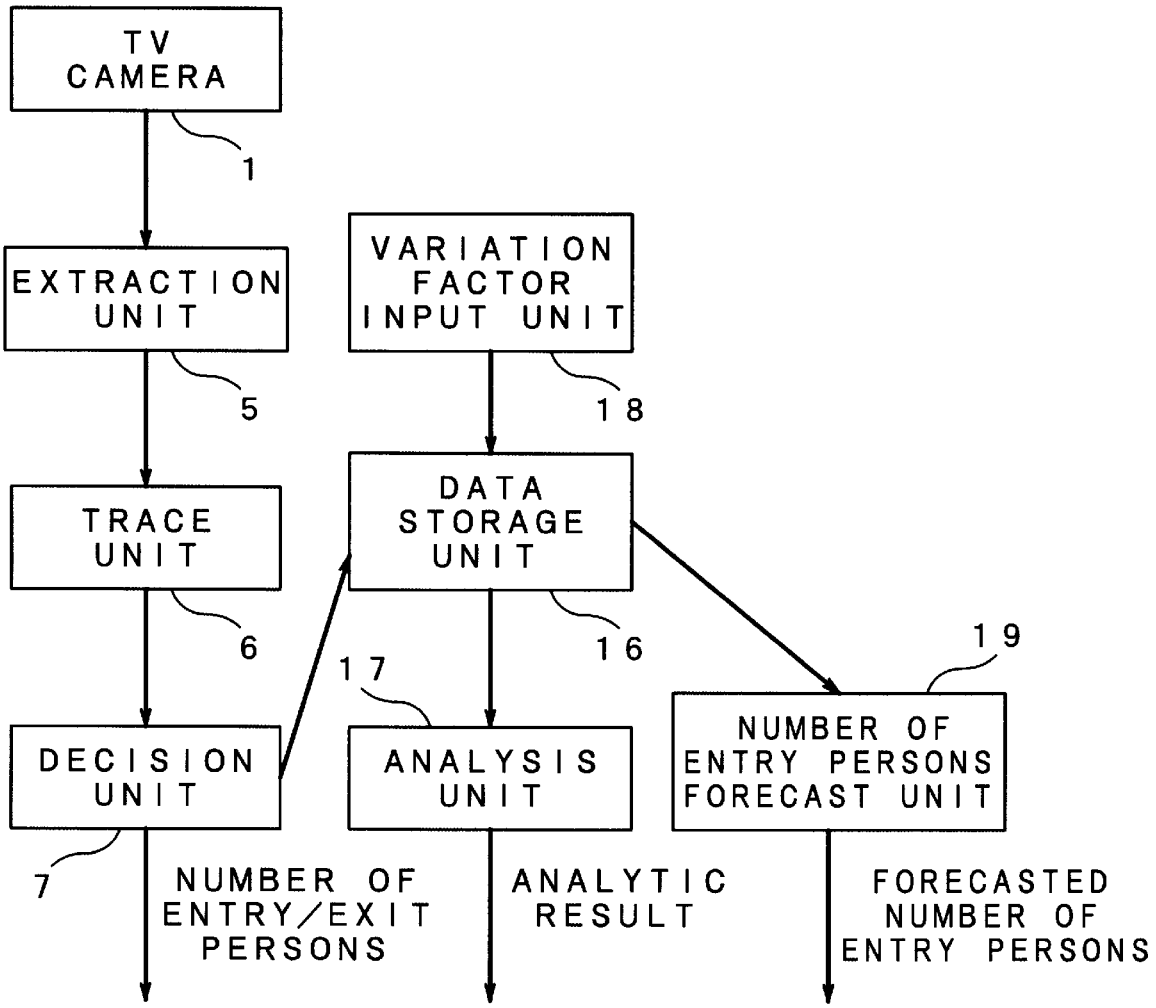
FIG. 21 is a chart explaining a flow of data in the fifth embodiment.

FIG. 20 shows a construction of a fifth embodiment of this invention, and FIG. 21 shows a data flow thereof. This embodiment is based on the fourth embodiment, in which the bus is further connected with an entry person forecast unit 19 for forecasting the number of entry persons based on the number of persons stored in data storage unit 16.

A function of the forecast unit 19 for forecasting the number of visitors will be described hereinafter. The unit is so designed to access the data storage unit 16 to find an average number of visitors on the same day (time zone) of the past several weeks and produce the average number as a forecasted number of persons. More precise forecast may be performed by finding an average number for each day of the week at the beginning/around the middle/at the end of the month based on the data of the past several months, confirming whether the day and date of the forecast is the day of the week at the beginning, around the middle or at the end of the month, and outputting the average number on the corresponding day of the week as a forecasted number of the persons.

The accuracy of the forecast about the number of visitors may be improved by analyzing the affection to the number of visitors by a variation factor based on the past data to be reflected on the forecast and plan of the variation factor. For example, a forecasted number of persons may be obtained by investigating weather of the day and time of the forecast according to a weather report, and extracting past data corresponding to a special event in sales promotion and local information to find the average if any. In case that the number of the corresponding data is small, assuming 15% reduction on a rainy day, the average number of persons on the corresponding day of the week is found irrelevant to the weather so that the found number decreased by 15% may be generated as a forecasted number of persons.

Various forecasting methods may be applied to this embodiment to seek a forecasted number of persons such that the deviation and standard deviation is obtained when the average for each day of the week is found, and the forecasted number may be displayed together with the range of errors. One example of the display of a result of the forecast is shown in FIG. 22. Since other construction and effects are the same as those of the foregoing embodiments, the same reference numbers are applied to this embodiment and the detailed explanation is omitted.

Figure 23:
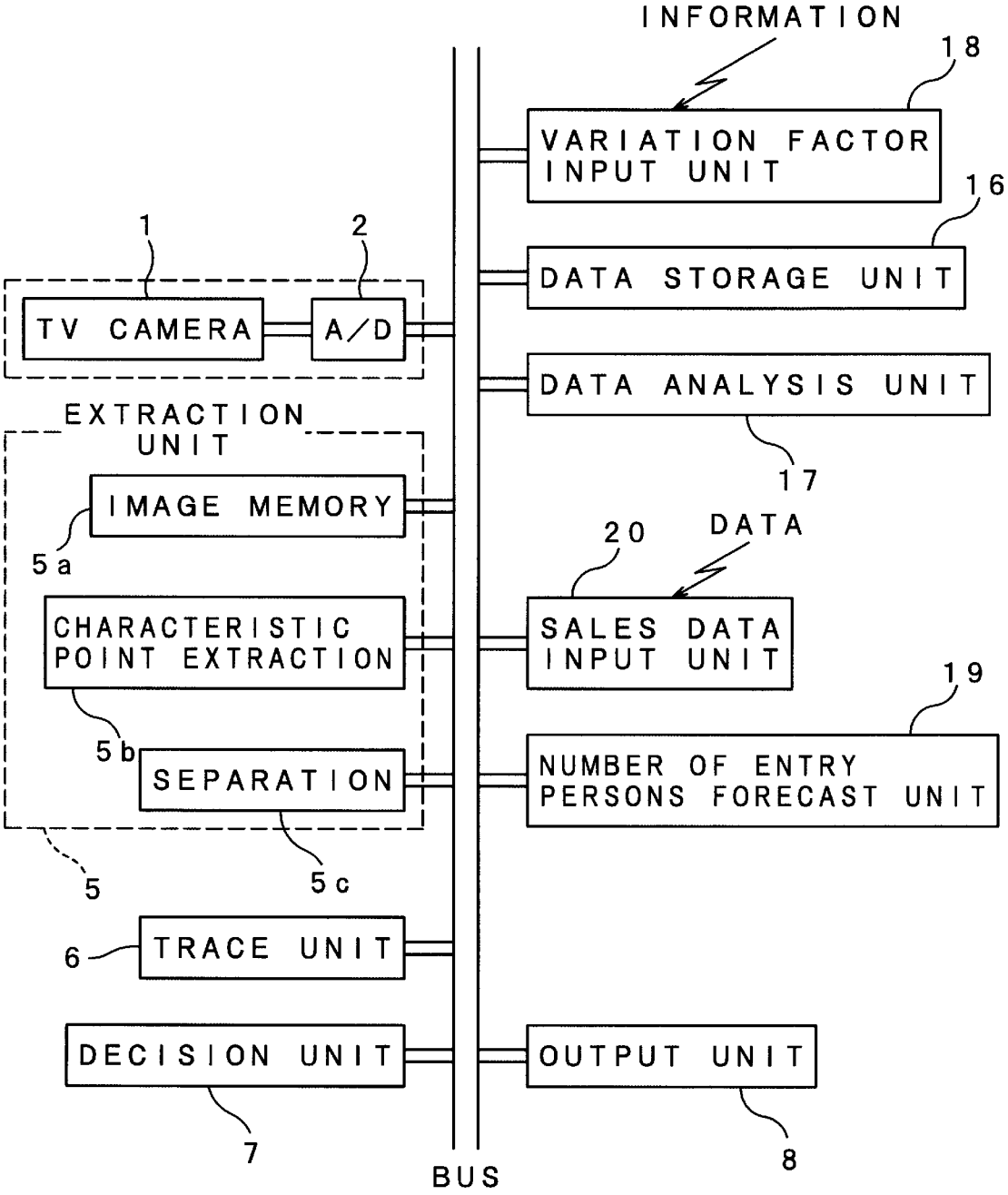
FIG. 23 is a schematic block diagram of a device as a sixth embodiment of this invention.
Figure 24:
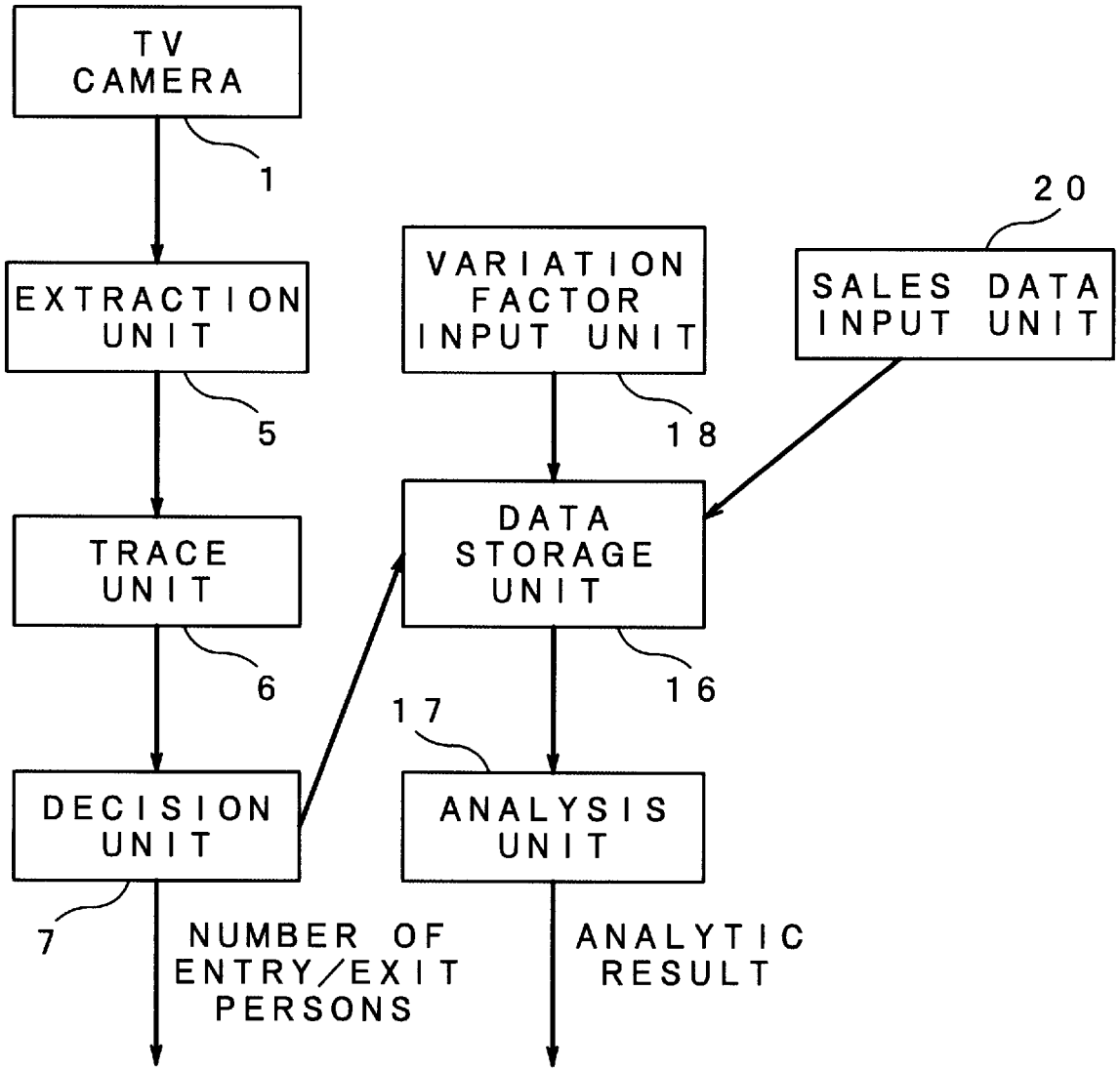
FIG. 24 is a chart explaining a flow of data in the sixth embodiment.

FIG. 23 shows a construction of a sixth embodiment of this invention, and FIG. 24 shows a data flow thereof. In addition to the construction of the fifth embodiment, a sales data input unit 20 is connected with the bus. The input unit 20 is designed to enter sales data stored in POS by transmission. One example of the input of the sales data is shown in FIG. 25, wherein the number of sold goods is adapted to be entered for each item and each time zone.

As seen in FIG. 24, the sales data produced from the sales data input unit 20 is stored in the data storage unit 16 together with and relating with the number of entry and exit persons found in the decision unit 7 and the variation factor data produced from the variation factor input unit 18.

Data analysis unit 17 analyzes the relation between the sales data and the number of entry and exit persons to seek the sales amount by the visitors a day and by one staying person for one hour to be outputted. Thus, the data which cannot be obtained by the sales management in POS can be collected. For instance, there may be obtainable for each day, each time and each floor such information as "the sales amount is large or small in comparison with the entry and exit of persons". Based on the information there may be quantitatively known problems and effects about advertisement, goods in stock, and display. Since other construction and effects are the same as those of the foregoing embodiments, the same reference numbers are applied to this embodiment and the detailed explanation is omitted. Though the forecast unit 19 forecasting the number of visitors is connected with the bus as shown in FIG. 13, the unit 19 may be omitted because the relation between the sales data and the number of visitors is analyzed in this embodiment.

Figure 26:
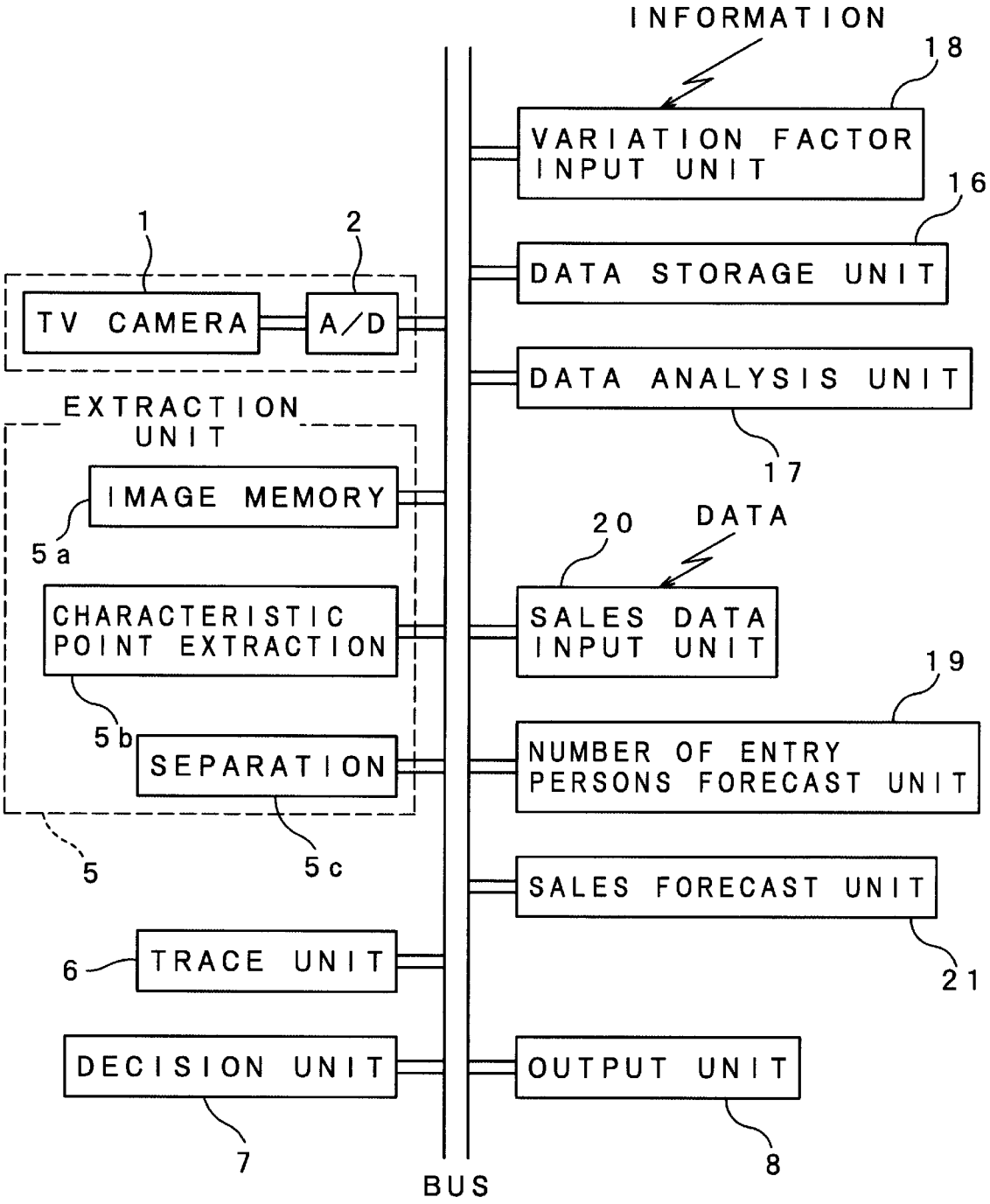
FIG. 26 is a schematic block diagram of a device as a seventh embodiment of this invention.
Figure 27:
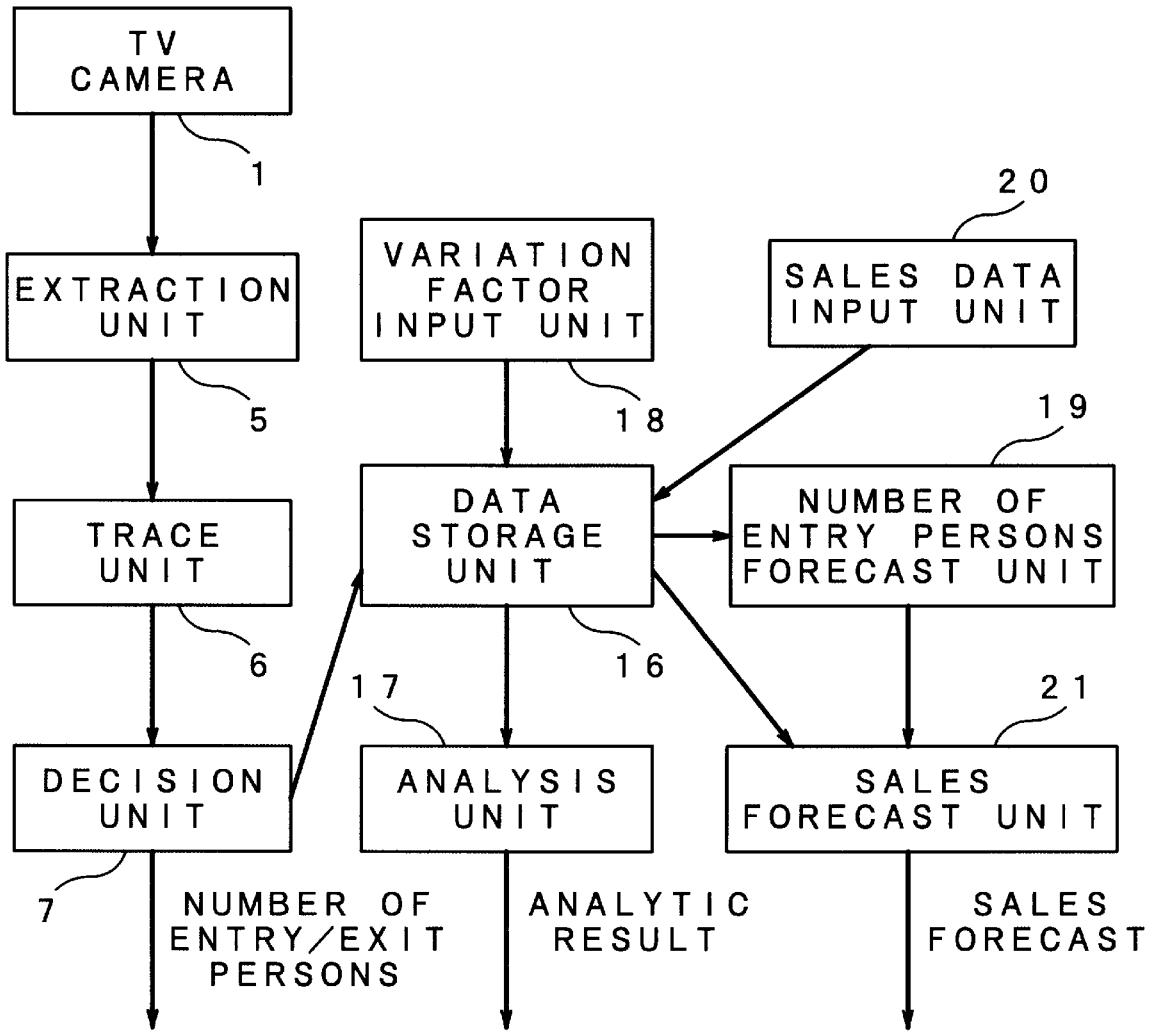
FIG. 27 is a chart explaining a flow of data in the seventh embodiment.

FIG. 26 shows a construction of a seventh embodiment of this invention, and FIG. 27 shows a data flow thereof. This embodiment is based on the above-mentioned sixth embodiment (including the forecasting unit 19 for forecasting the number of visitors), in which a sales forecast unit 21 is connected with the bus.

As shown in FIG. 27 the sales forecast unit 21 receives the number of entry and exit persons (particularly visitors) and the sales data in the past which are stored in the data storage unit 16 and further the forecasted number of visitors at the date and time of the sales forecast from the entry person forecast unit 19. Based on the number of entry persons and the sales data in the past, the unit 21 finds the number of sold articles for each goods to one entry person (or a unit number of persons) to be multiplied by the forecasted number of entry persons at the date and time when the sales is forecasted, whereby the forecasted number of sold articles for each goods is obtained. Thus obtained forecasted numbers of articles are outputted to the output unit 18 by way of an example as shown in FIG. 28.

For more precise forecast, the variation factor data must be effectively used when the number of entry persons is forecasted, whereby the decision of purchase volume according to the forecasted number of articles and the disposition of clerks and janitors may be made properly.

The forecast of the number of sold articles is based on the number of entry persons, but may be based on the number of persons staying within the store if desired. Since other construction and effects are the same as those of the foregoing embodiments, the same reference numbers are applied to this embodiment and the detailed explanation is omitted.

Figure 29:
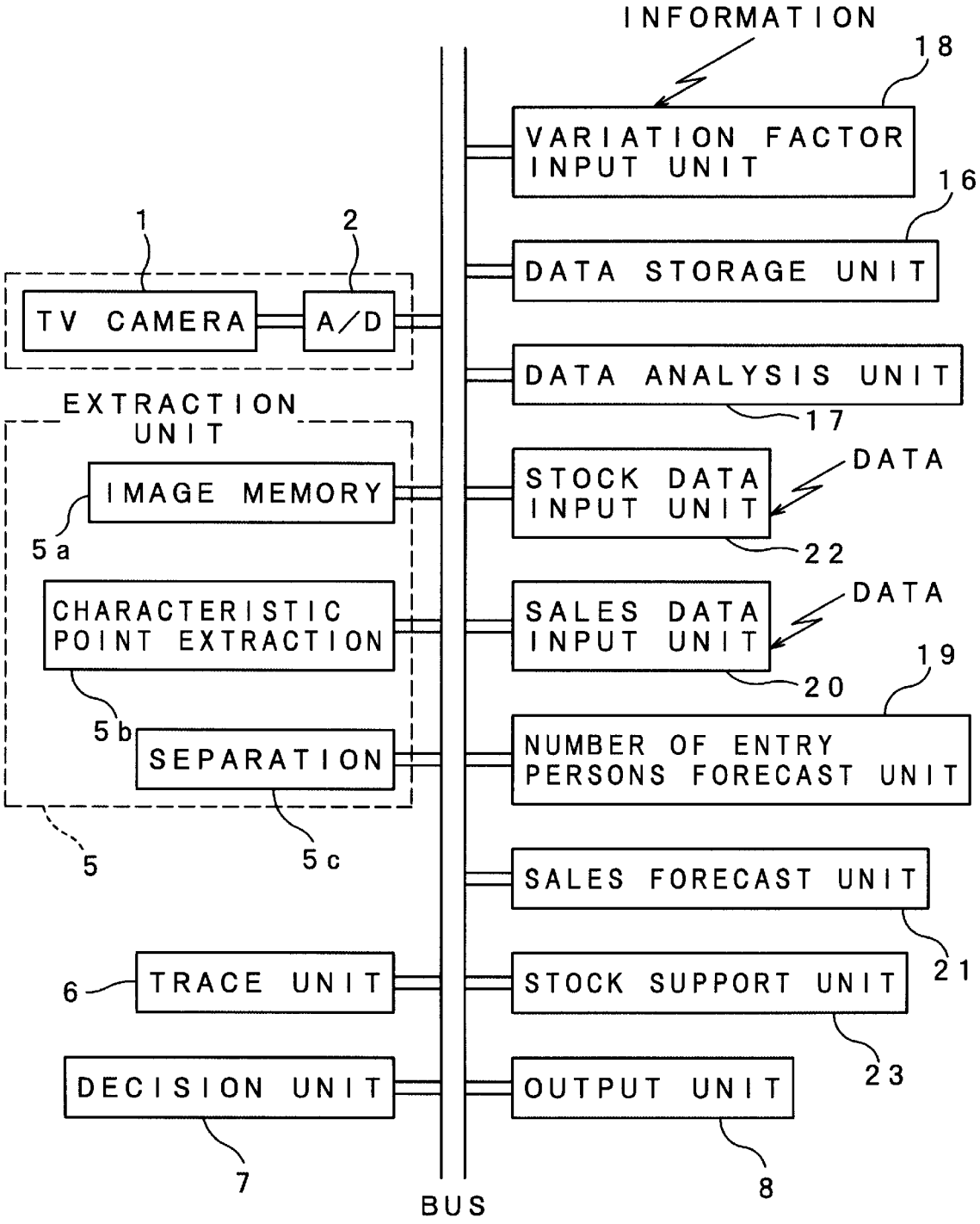
FIG. 29 is a schematic block diagram of a device as an eighth embodiment of this invention.
Figure 30:
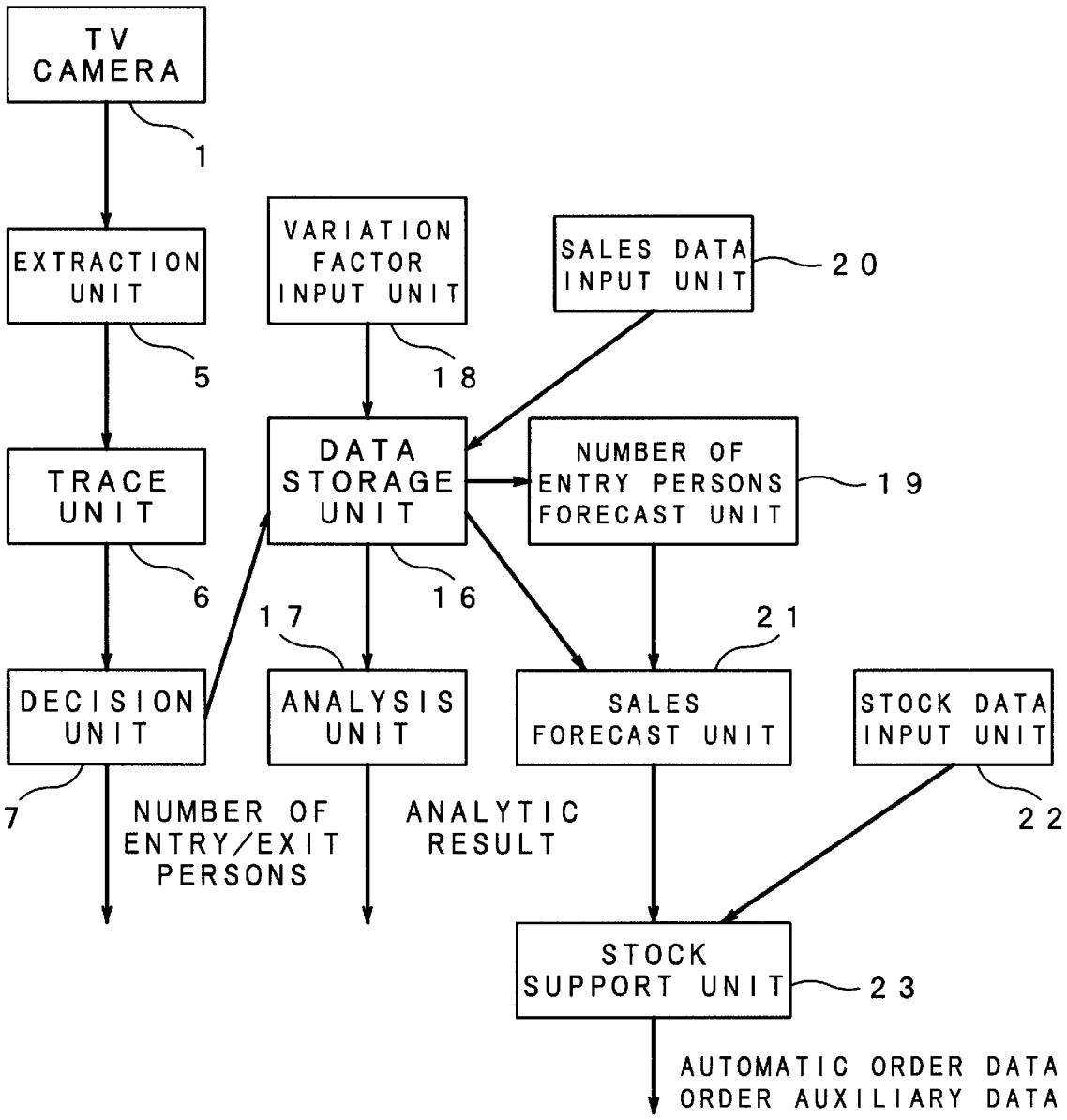
FIG. 30 is a chart explaining a flow of data in the eighth embodiment.

FIG. 29 shows a construction of an eighth embodiment of this invention, and FIG. 30 shows a data flow thereof. This embodiment is based on the seventh embodiment, in which the bus is further connected with a stock data input unit 22 and a stock support unit 23. The stock data input unit 22 is designed to enter stock data registered in POS by transmission the same as the sales data input unit 20 enters. FIG. 31 shows an example of input of the stock data in which the numbers of sold articles are entered for each goods and in each time zone. It is apparent in comparison with the table of FIG. 25 that the stock data is revised on the real time basis whenever the corresponding goods is sold to decrease the number of articles in stock. When articles are carried in, the number of the articles in stock is increased.

Based on the number of articles in stock about the current predetermined goods given by the stock data input unit 22 and the forecasted number of sold articles (the computation of the forecasted number of the sold articles is the same as that of the seventh embodiment) about the goods given by the sales forecast unit 21, the stock support unit 23 finds the number of articles to be carried in when the respective goods should be carried in. Thus the stock may be kept as small as possible until the following carry-in and the number of articles may be set so as to keep goods in stock whereby the purchase of goods with good efficiency is guaranteed and it may be avoided to uselessly dispose of the goods having expiration of taste or give guests trouble due to out of stock. Increase of storage fee by storage more than the necessity can be decreased as far as possible in case of goods having no expiration of taste. Thus, a merchandise management with a good efficiency is ensured.

For instance, as shown in FIG. 32, an output is made relating with the number of articles to be delivered about necessary goods in each delivery time. A cell marked by a hyphen "-" in the table of FIG. 32 shows that no goods is delivered at the delivery time.

The output as shown in FIG. 32 in a table format is displayed on a monitor or printed out as order support data to give an advice or warning to a person in charge of purchasing. Moreover, such data may be used as an order data to automatically request future delivery and make an order. Since the time when the respective goods becomes out of stock can be predicted, the preparation for that can be easily performed. Since other construction and effects are the same as those of the foregoing embodiments, the same reference numbers are applied to this embodiment and the detailed explanation is omitted.

Figure 33:
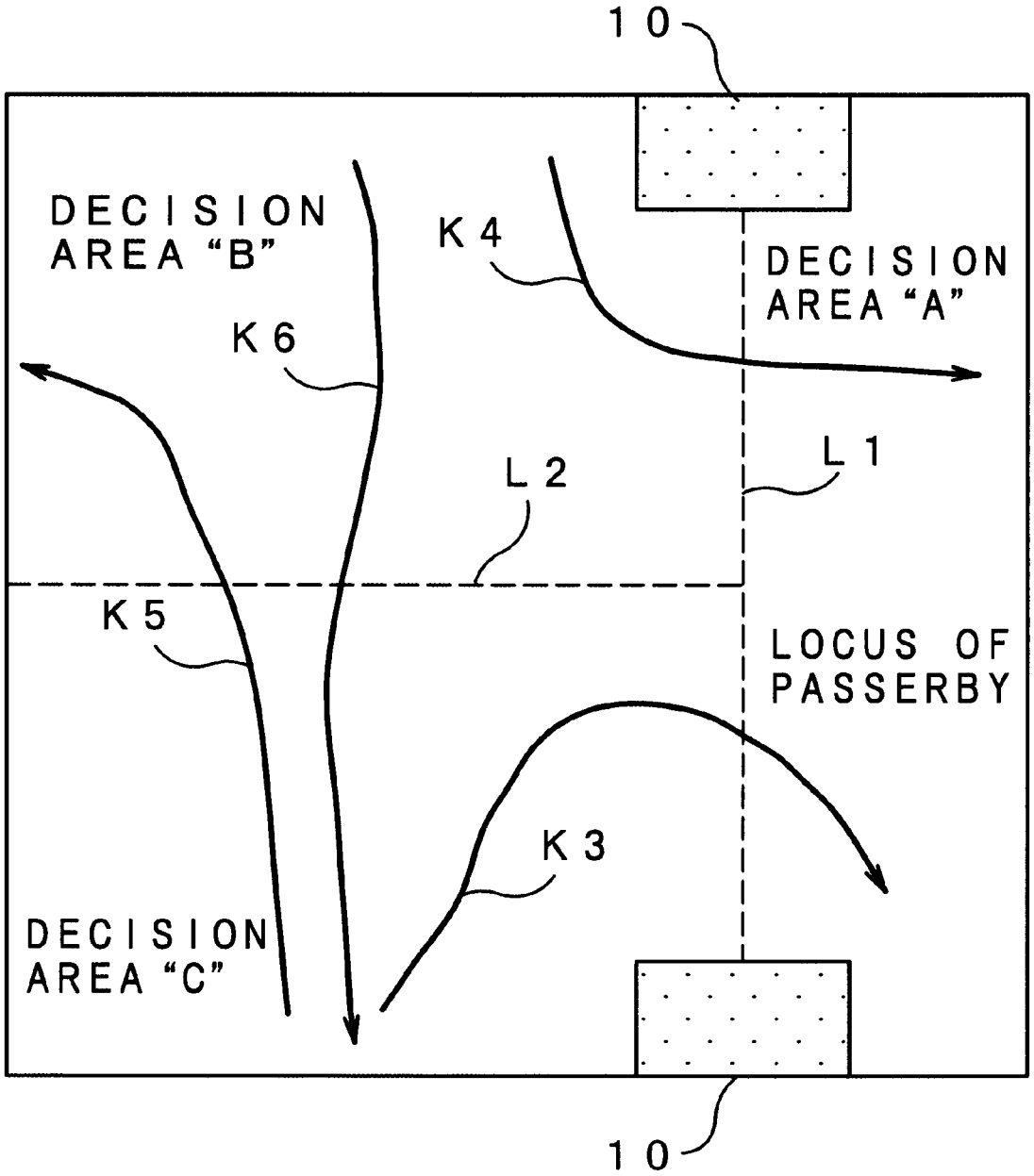
FIG. 33 is an illustration explaining a ninth embodiment of this invention.

FIGS. 33 and 34 show a ninth embodiment of this invention. This embodiment is based on the first embodiment, in which the counting operation about the number of persons in the decision unit 7 is improved to measure passage state more in detail. A pair of decision lines L1 and L2 are provided to separate a measuring area taken by a camera into three sections. Practically, in the same way as that of the first embodiment, a decision area A located on the right hand side of the decision line L1 set in a gateway between pillars 10, 10 is the inside of a store. An outside area of the store located on the left hand side of the decision line L1 is divided into areas B and C by a decision line L2.

A movement state of a person is decided by confirming which area of A, B and C is positioned by the initial and end points of a dynamic line obtained by tracing a movement flow of the person by extraction unit 5 and trace unit 6. For instance, when the initial point is positioned in the decision area C and the end point is positioned in the decision area A (a locus marked by K3), the person is known to be an entry person moving from the bottom side of the drawing. When the initial point is positioned in the decision area B and the end point is positioned in the decision are A (a locus marked by K4), the person is known to be an entry person moving from the upper side of the drawing. In addition to counting the number of entry persons the information which direction are a larger number of persons entering from is measured and analyzed.

When the initial and end positions are positioned in the decision areas B and C (loci K5 and K6), the persons are decided to be just passersby passing in front of the store. Which direction has a larger number of passersby can be known by measuring which area is positioned by which point of the initial and end points when the passersby are passing in front of the store. Accordingly, the display within a window near the gateway and the layout of stalls or wagons arranged on the outside of the store can be decided in accordance with the number of passersby, resulting in sales advertisements and sales strategies with good efficiency. FIG. 34 shows the relation between the area positioned by the initial or end point and the state of the movement.

A quantity of passersby around a facility is known by deciding a movement state shown in FIG. 34 based on the state which area is positioned by the initial or end point of a given dynamic line, which provides evaluation about conditions of location for developing chain stores and the relation between the increase and decrease of visitors and the increase and decrease of passersby to perform the efficient management of a store or facility.

Thus function in the decision unit is performed by the processes below repeatedly in turn, assuming that such data (the relation between the moving state and the initial and end points) as shown in FIG. 34 is available in a table.

(1) to obtain data (coordinates of the initial and end points) of a dynamic line by trace unit 6.

(2) to decide a moving state based on the obtained data referring to the table (as shown in FIG. 34).

(3) to add the number of persons in the decided state of movement by "1".

If desired, the above-mentioned decision may be performed by inquiry steps as shown in FIG. 10 to inquire which area is positioned by initial or end point for deciding the final state of the movement, without employing the above-mentioned table.

This embodiment is based on the first embodiment, but may be combined with one of the embodiments from the second to the eighth (the same thing may be applied to embodiments described later).

Figure 35:
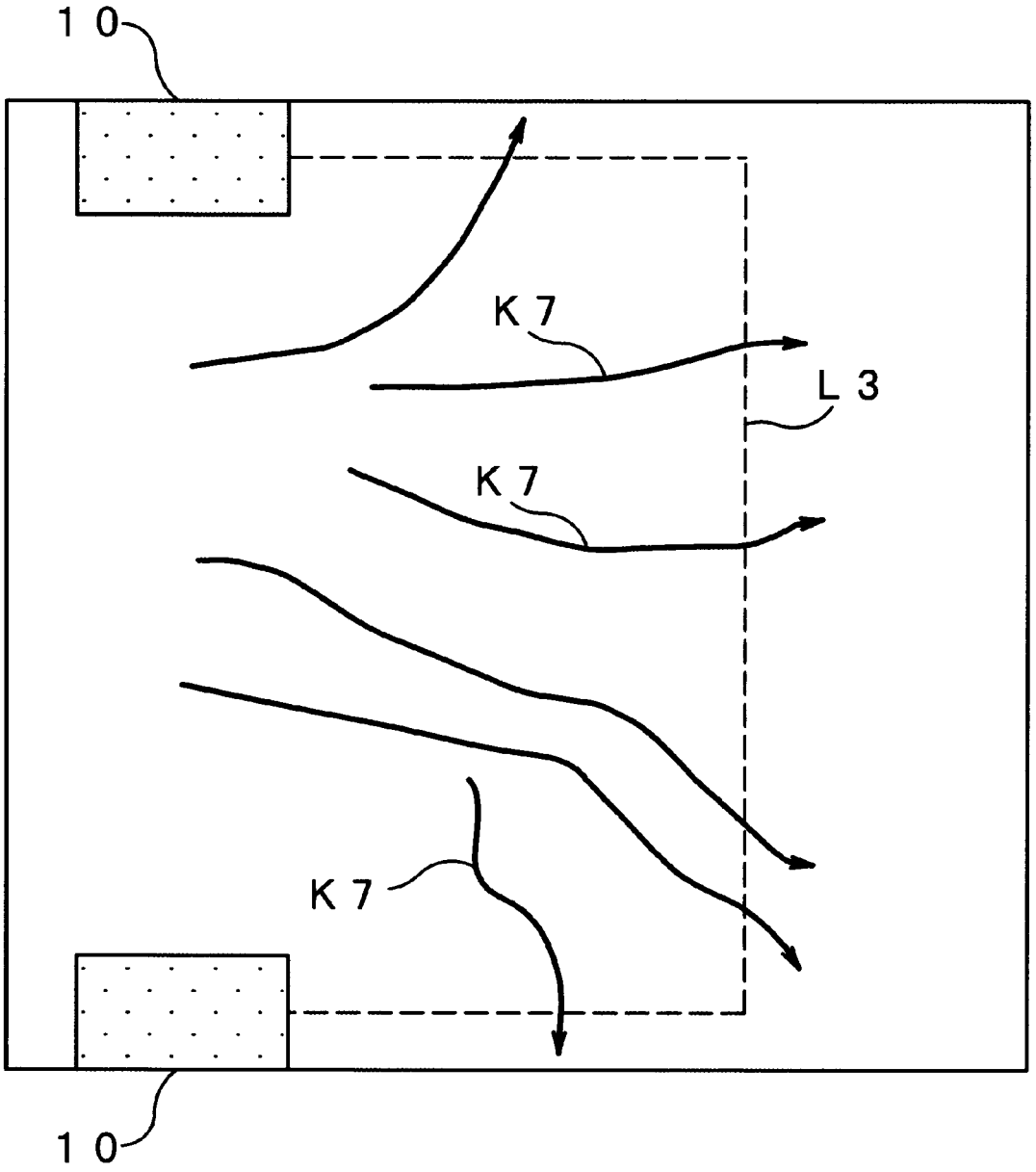
FIG. 35 is an illustration explaining a tenth embodiment of this invention.

FIG. 35 shows a tenth embodiment of this invention in which the decision unit of the foregoing embodiments is improved. Since the decision line L is set at the position of the gateway (between pillars 10, 10) in the respective embodiments as represented by the first embodiment, the accuracy of separation and trace is lowered when a lot of persons who contact each other in all directions enter at the opening of a store such as a department store, a pinball parlor or the like. If a lot of persons pass the gateway at the same time, it is difficult even to this invention employing stereo images to separate the persons who actually contact each other and enter through the gateway. As they disperse in all directions to move to their goal after passing the gateway, the respective distances to near persons are enlarged and they are separated. Occasionally, any detection is not available at the gateway as shown by the loci K7 of FIG. 35, but persons may be separated and traced after they enter the store.

In this embodiment as shown in FIG. 35, a decision line L3 is set at a proper distance (a position where the entering persons overlapping at a gateway are gradually dispersing)

from the gateway (the line between pillars 10 and 10 in the drawing), and the measuring accuracy is not lowered at the gateway or in a time zone in which a lot of persons enter at the same time, for instance, when a store opens. The decision unit 7 may employ the same process flow as that of FIG. 9 or 10. Since other construction and effects are the same as those of the foregoing embodiments, the detailed explanation is omitted.

Figure 36:
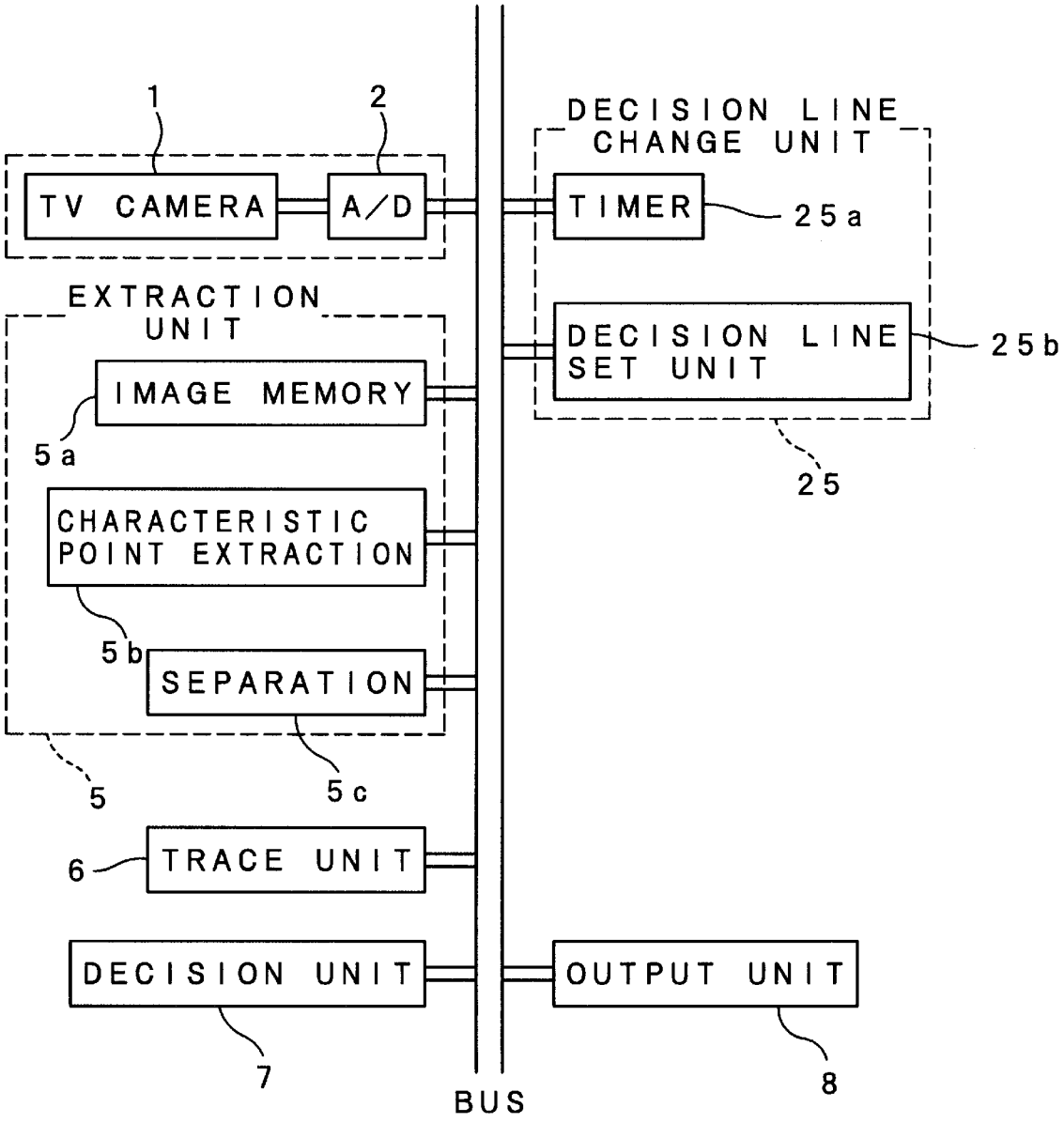
FIG. 36 is a schematic block diagram of an eleventh embodiment of this invention.
Figure 37:
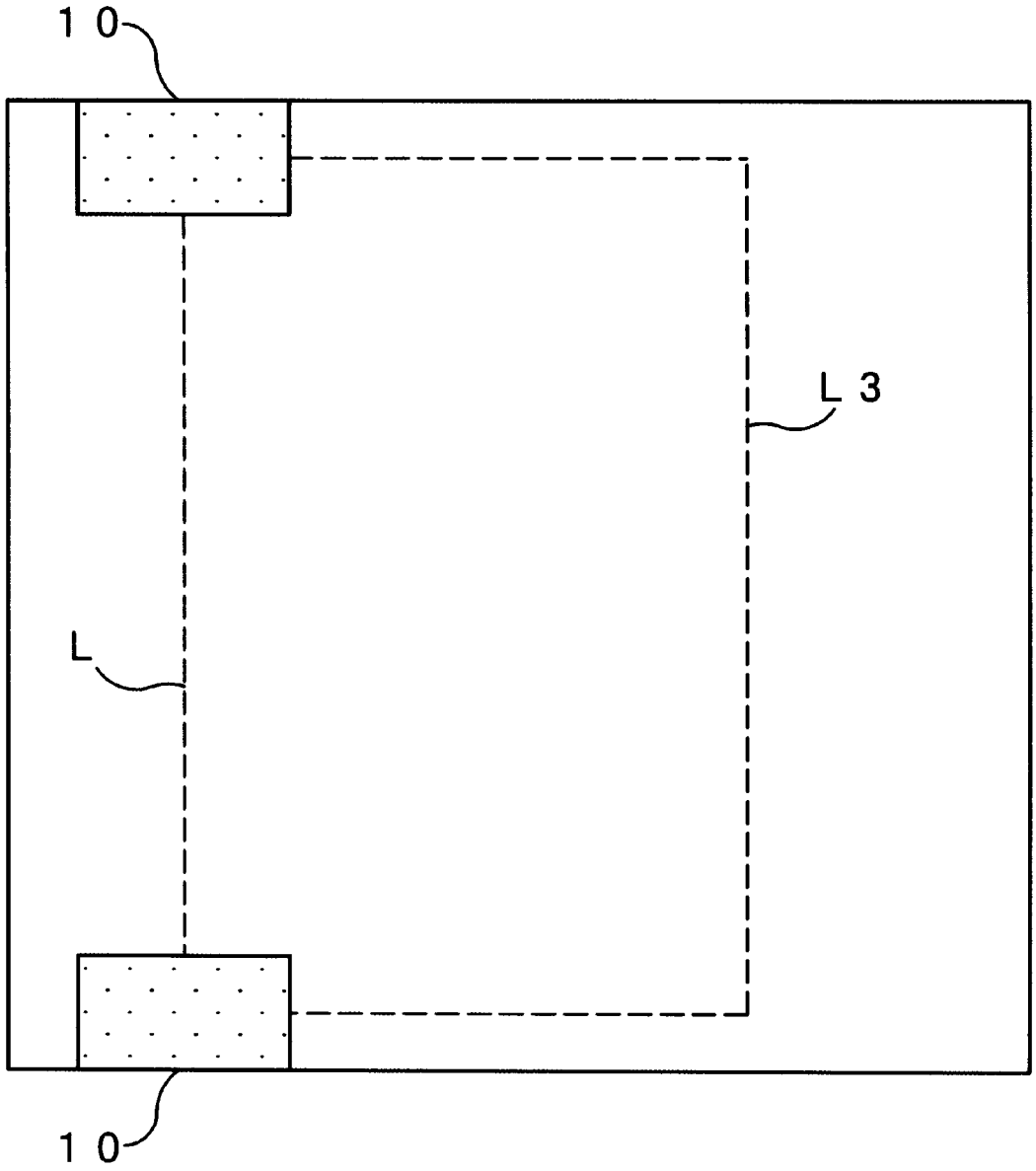
FIG. 37 is an illustration explaining its operation.

FIGS. 36 and 37 show an eleventh embodiment of this invention. This embodiment is based on the tenth embodiment in which the decision line can be changed according to a time. As shown in FIG. 37 a normal decision line L is set to a position of a gateway, and a temporal decision line L3 is set at a distance from the gateway as set in the tenth embodiment when a lot of persons pass the gateway all together at the opening of the store, by which the number of persons is measured.

As a device for performing the above operation, this embodiment provides a device including a basic construction employing the device of FIG. 1 and further a decision line change unit 25 connected with the bus. The decision line change unit 25 is provided with a timer section 25*a* and a decision line set section 25*b*, in which a predetermined time is set to the timer section 25*a* because a lot of persons can be forecasted to rush into the gateway during the predetermined time from the opening.

The decision line set section 25*b* sets the decision line into L3 when the store opens (at the start of the operation), and the decision unit 7 counts the number of persons based on the decision line L3 set by the section 25*b*. Thus, the number of persons can be precisely measured based on the same theory as that of the tenth embodiment even if a lot of persons pass the gateway just after the opening of the store. Upon detecting lapse of the predetermined time from the opening by an output from the timer section 25*a*, the decision line set section 25*b* resets the decision line to the normal line L so that the decision unit 7 may count the number of persons based on the reset decision line L. Since other construction and effects are the same as those of the first embodiment, the same reference numbers are applied to this embodiment and the detailed explanation is omitted. The decision line change unit 25 may be applied to any one from the second to the ninth embodiment.

When an area divided by the decision line L3 and the reference decision line L is a passage or a free space within the store, some person just passes through the divided area. When some person has such a dynamic line that one of the initial and end points appears on the area divided by the decision lines L3 and L and another one exists on the inside of the decision line L3 (the inside of the store), the number of persons is increased by the person if the decision line L3 is a sole line for decision, so that the accuracy of the measurement in normal hours is lowered because in fact the person does not pass the gateway.

Accordingly, in this embodiment, the decision line is temporarily set away from the gateway at the opening of the store when any precise decision cannot be expected by the decision line set in the gateway and the number of persons is measured based on the decision line set away from the gateway, so that relatively high accurate measurement for the number of persons may be expected at the opening of the store and the number of persons passing through the gateway can be measured in normal hours when a large number of persons do not pass the gateway at the same time. Thus this embodiment provides a high accurate measurement either in normal hours and at the opening of a store.

The change of the decision line may be performed by a clock, not the timer, and the set line may be changed when a predetermined time comes so that a proper decision line is set according to a time zone. Without employing such uniform change according to a time, the decision line may be changed when a predetermined condition is satisfied, for example, when the number of persons who enter or leave or exist in the image or at the gateway becomes a predetermined number or larger.

Thus, according to the foregoing embodiments, a measuring area such as a gateway or passage is synchronously taken at the same timing by a plurality of pickup means set to have near parallel optical axes, and space coordinate data provided by the correspondence between the images taken by the pickup means is employed so as to precisely separate the respective persons even if they overlap in a depth direction, whereby passersby are so separated and traced that the number of pass persons in each movement direction is precisely measured. In other words the number of persons can be precisely measured without any affection by the person's overlap in any direction and sunlight changes or shadows. The measuring area may be taken by the pickup means at a angle of depression irrelevant to the existence or absence of a ceiling or the height of a ceiling, so that the restriction of installation is relaxed.

The device having a function for discriminating a direction of movement of person can measure a flow of persons and a detailed movement state of persons such as the number of entry and exit persons or staying persons. The device employing a temporal decision line may precisely measure the number of persons even when a lot of persons pass through a measuring area such as an entrance at one time.

Acceding to the device having various forecasting functions, various managements about sales, store, stock and purchase may be performed with a good efficiency.

Though this invention has been described and illustrated with respect to certain embodiments which give satisfactory results, it will be understood by those skilled in the art that numerous modifications and rearrangements could be made without departing from the spirit and scope of the invention, and it is, therefore, intended in the appended claims to cover all such modifications and rearrangements.

What is claimed is:

1. A device for measuring the number of passing persons comprising a plurality of camera means arranged in parallel with respect to their optical axes for taking an image in a measuring area to measure the number of persons, extracting means for extracting a person based on image data taken by said plurality of camera means, tracing means for tracing the person extracted by said extracting means, and counting means for counting the number of persons passing a predetermined measuring position based on data provided by said tracing means, said device employing space coordinate data by correspondence between a plurality of images provided at the same timing by said plurality of camera means to extract the passing person.

2. A device as set forth in claim 1 in which said counting means for counting the number of persons passing said predetermined measuring position is further provided with a function for discriminating a movement direction of a person passing said measuring position.

3. A device as set forth in claim 1 in which said measuring area is a gateway, and said counting means counts the number of persons passing said predetermined measuring position by discriminating between an entering person and a leaving person based on a movement direction of said person which is provided by said tracing means.

4. A device as set forth in claim 1 in which said extracting means obtains space coordinate data of the respective characteristic points constituting a person, and separates and extracts the respective persons by recognizing that the obtained characteristic points having near distances are based on the same person by integrating the same and the points having far distances are based on a different person.

5. A device as set forth in claim 1 further including excluding means for excluding a particular person from the extracted and traced persons.

6. A device as set forth in claim 3 in which a different measuring position is provided on the outside of said gateway so that a person walking on said outside can be counted.

7. A device as set forth in claim 3 in which the measuring position for finding a passage in the image is set at a predetermined distance from the position corresponding to said gateway in the image and the number of persons passing the gateway is counted based on said set measuring position.

8. A device as set forth in claim 3, in which the measuring position for finding a passage in the image is represented by a first measuring position corresponding to said gateway in the image or a second measuring position set at a predetermined distance from said first measuring position, and said device further includes measuring position setting means for selecting and setting one of said first measuring position and said second measuring position based on a predetermined condition, whereby the number of persons passing the gateway is counted based on said selectively set measuring position.

9. A system for managing the number of entry persons who enter an area and exit persons who leave the area comprising:

a plurality of camera means arranged in parallel with respect to their optical axes for taking an image in a measuring area to measure the number of persons;

extracting means for extracting a person based on image data taken by said plurality of camera means;

tracing means for tracing the person extracted by said extracting means;

counting means for counting the number of persons passing a predetermined measuring position based on data provided by said tracing means;

storage means for storing data representing the number of entry and exit persons produced by said device; and analysis means for analyzing said stored data;

said system employing space coordinate data by correspondence between a plurality of images provided at the same timing by said plurality of camera means to extract the passing person, and said measuring area is a gateway, and said counting means counts the number of persons passing said predetermined measuring position by discriminating between an entering person and a leaving person based on a movement direction of said person which is provided by said tracing means.

10. A system as set forth in claim 9 further comprising: input means for entering variation factor data of various data which are factors varying the number of persons entering a store, in which said variation factor data are stored in said storage means together with data of the number of entry and exit persons produced by/said system.

11. A system as set forth in claim 9 further comprising: forecasting means for forecasting the number of entry persons based on said stored and analyzed data.

12. A system as set forth in claim 9, further comprising: sales data input means for entering sales data to analyze the relation between the sales data and the data of the number of entry and exit persons by said analysis means.

13. A system as set forth in claim 9 further comprising: forecasting means for forecasting the number of entry persons based on said stored and analyzed data, sales data input means for entering sales data, and sales forecasting means for forecasting sales based on said forecasted number of entry persons, and the past stored number of entry persons and sales data.

14. A system as set forth in claim 13 further comprising: stock data input means for entering stock data, stock support means for deciding recommendation of items and quantity of stock goods based on sales data and stock data which are forecasted by said sales forecasting means.

15. A system for managing the number of entry persons who enter an area and exit persons who leave the area comprising:

a plurality of camera means arranged in parallel with respect to their optical axes for taking an image in a measuring area to measure the number of persons;

extracting means for extracting a person based on image data taken by said plurality of camera means;

tracing means for tracing the person extracted by said extracting means;

counting means for counting the number of persons passing a predetermined measuring position based on data provided by said tracing means;

storage means for storing data representing the number of entry and exit persons produced by said system; and analysis means for analyzing said stored data;

said system employing space coordinate data by correspondence between a plurality of images provided at the same timing by said plurality of camera means to extract the passing person, said measuring area is a gateway, and said counting means counts the number of persons passing said predetermined measuring position by discriminating between an entering person and a leaving person based on a movement direction of said person which is provided by said tracing means, and the measuring position for finding a passage in the image is represented by a first measuring position corresponding to said gateway in the image or a second measuring position set at a predetermined distance from said first measuring position, and said device further includes measuring position setting means for selecting and setting one of said first measuring position and said second measuring position based on a predetermined condition, whereby the number of persons passing the gateway is counted based on said selectively set measuring position.

16. A system as set forth in claim 15 further comprising: input means for entering variation factor data of various data which are factors varying the number of persons entering a store, in which said variation factor data are stored in said storage means together with data of the number of entry and exit persons produced by said system.

17. A system as set forth in claim 15 further comprising: forecasting means for forecasting the number of entry persons based on said stored and analyzed data.

18. A system as set forth in claim 15, further comprising: sales data input means for entering sales data to analyze the relation between the sales data and the data of the number of entry and exit persons by said analysis means.

19. A system as set forth in claim 15 further comprising: forecasting means for forecasting the number of entry persons based on said stored and analyzed data, sales data input means for entering sales data, and sales forecasting means for forecasting sales based on said forecasted number of entry persons, and the past stored number of entry persons and sales data.

20. A system as set forth in claim 19 further comprising: stock data input means for entering stock data, stock support means for deciding recommendation of items and quantity of stock goods based on sales data and stock data which are forecasted by said sales forecasting means.

* * * * *